US008297937B2

(12) United States Patent
Johnson

(10) Patent No.: US 8,297,937 B2
(45) Date of Patent: Oct. 30, 2012

(54) PUMP CONTROL APPARATUS, SYSTEM AND METHOD

(75) Inventor: Stephen M. Johnson, Algonquin, IL (US)

(73) Assignee: STAK Enterprises, Inc., Lake in the Hills, IL (US)

( * ) Notice: Subject to any disclaimer, the term of this patent is extended or adjusted under 35 U.S.C. 154(b) by 1192 days.

(21) Appl. No.: 11/550,712

(22) Filed: Oct. 18, 2006

(65) Prior Publication Data

US 2007/0286737 A1 Dec. 13, 2007

Related U.S. Application Data

(60) Provisional application No. 60/804,499, filed on Jun. 12, 2006.

(51) Int. Cl.
*F04B 49/06* (2006.01)

(52) U.S. Cl. ..... 417/44.11

(58) Field of Classification Search ..... 417/44.11
See application file for complete search history.

(56) References Cited

U.S. PATENT DOCUMENTS

| | | | | | |
|---|---|---|---|---|---|
| 3,399,399 | A | | 8/1968 | Apfelbaum | |
| 3,485,262 | A | | 12/1969 | Perren | |
| 3,634,842 | A | * | 1/1972 | Niedermeyer | 417/14 |
| 3,894,240 | A | | 7/1975 | Rose | |
| 3,932,853 | A | | 1/1976 | Cannon | |
| 4,123,009 | A | * | 10/1978 | Kilpinen | 241/30 |
| 4,187,503 | A | | 2/1980 | Walton | |
| 4,195,968 | A | | 4/1980 | Emeny | |
| 4,369,438 | A | | 1/1983 | Wilhelmi | |
| 5,076,763 | A | * | 12/1991 | Anastos et al. | 417/44.11 |
| 5,314,313 | A | | 5/1994 | Janesky | |
| 5,324,170 | A | | 6/1994 | Anastos et al. | |
| 5,545,012 | A | | 8/1996 | Anastos et al. | |
| 5,549,456 | A | | 8/1996 | Burrill et al. | |
| 5,672,050 | A | | 9/1997 | Webber et al. | |
| 6,149,390 | A | | 11/2000 | Fisher et al. | |
| 6,464,531 | B2 | | 10/2002 | Eckert et al. | |
| 6,676,382 | B2 | | 1/2004 | Leighton et al. | |
| 6,709,240 | B1 | * | 3/2004 | Schmalz et al. | 417/44.11 |
| 7,309,216 | B1 | * | 12/2007 | Spadola et al. | 417/18 |
| 7,328,626 | B2 | * | 2/2008 | Beller et al. | 73/861 |
| 2004/0070357 | A1 | | 4/2004 | Kelly et al. | |
| 2005/0236591 | A1 | | 10/2005 | Wirthlin | |
| 2005/0236592 | A1 | | 10/2005 | Wirthlin | |
| 2006/0008355 | A1 | | 1/2006 | Low | |

OTHER PUBLICATIONS

Datasheet for ATMEL ATtiny15L 8-bit AVR Microcontroller with 1K Byte Flash; Jun. 2005; 85 pages; Atmel Corporation; San Jose, CA.

* cited by examiner

*Primary Examiner* — Devon Kramer
*Assistant Examiner* — Bryan Lettman
(74) *Attorney, Agent, or Firm* — K&L Gates LLP

(57) ABSTRACT

An apparatus, system and method for more accurately monitoring and determining pump failure. The apparatus and system include at least a power circuit, a current sensing circuit, alarm circuit and a controller. The controller is connectable to and receives an input from the current sensing circuit. The controller is configured to calculate a baseline operating current, current thresholds and operating conditions affecting the operation of the pump. The alarm circuit is connectable to and receives outputs from the controller, and provides alarm indications corresponding to operating conditions determined by the controller.

13 Claims, 14 Drawing Sheets

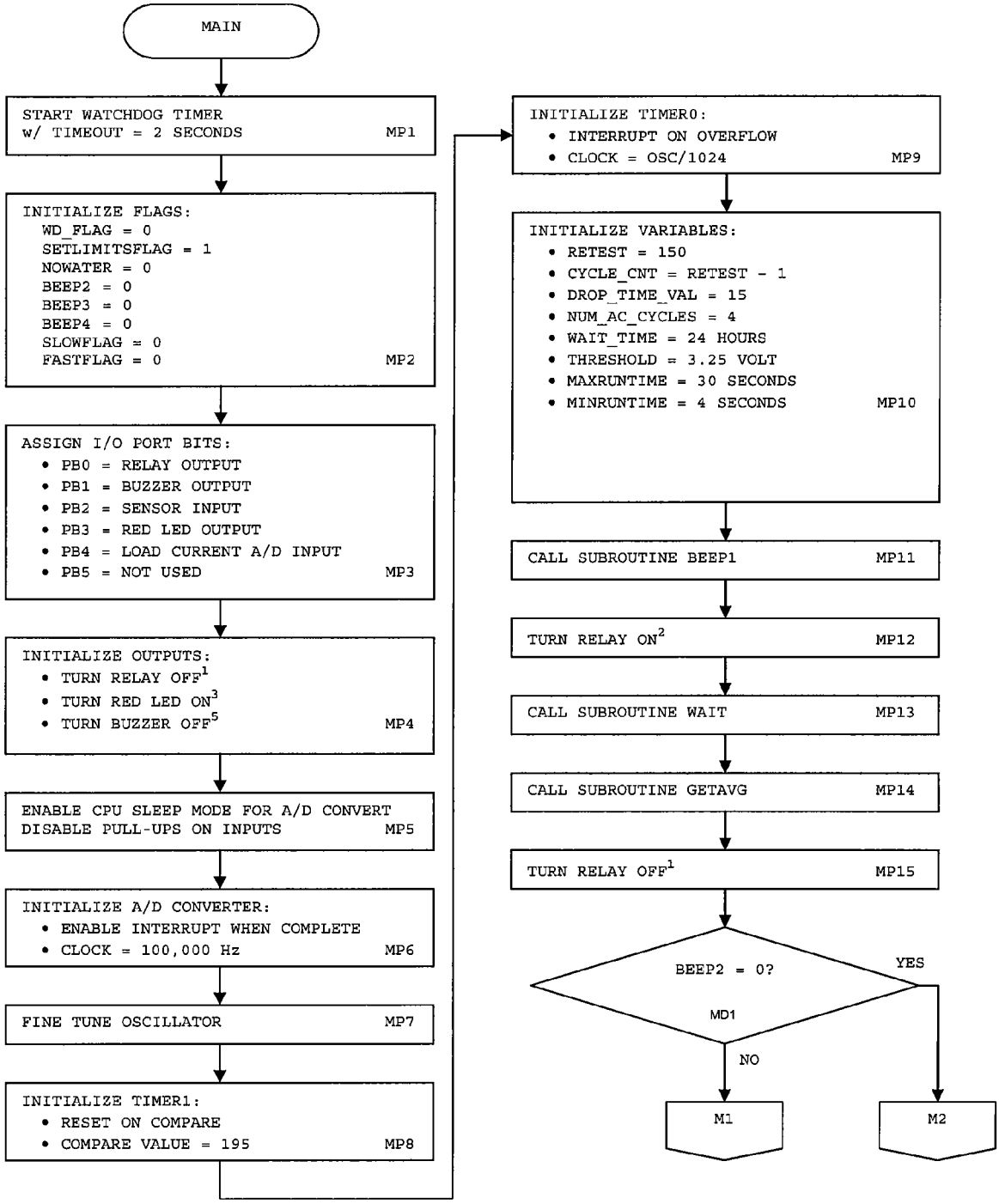
Figure 2.1

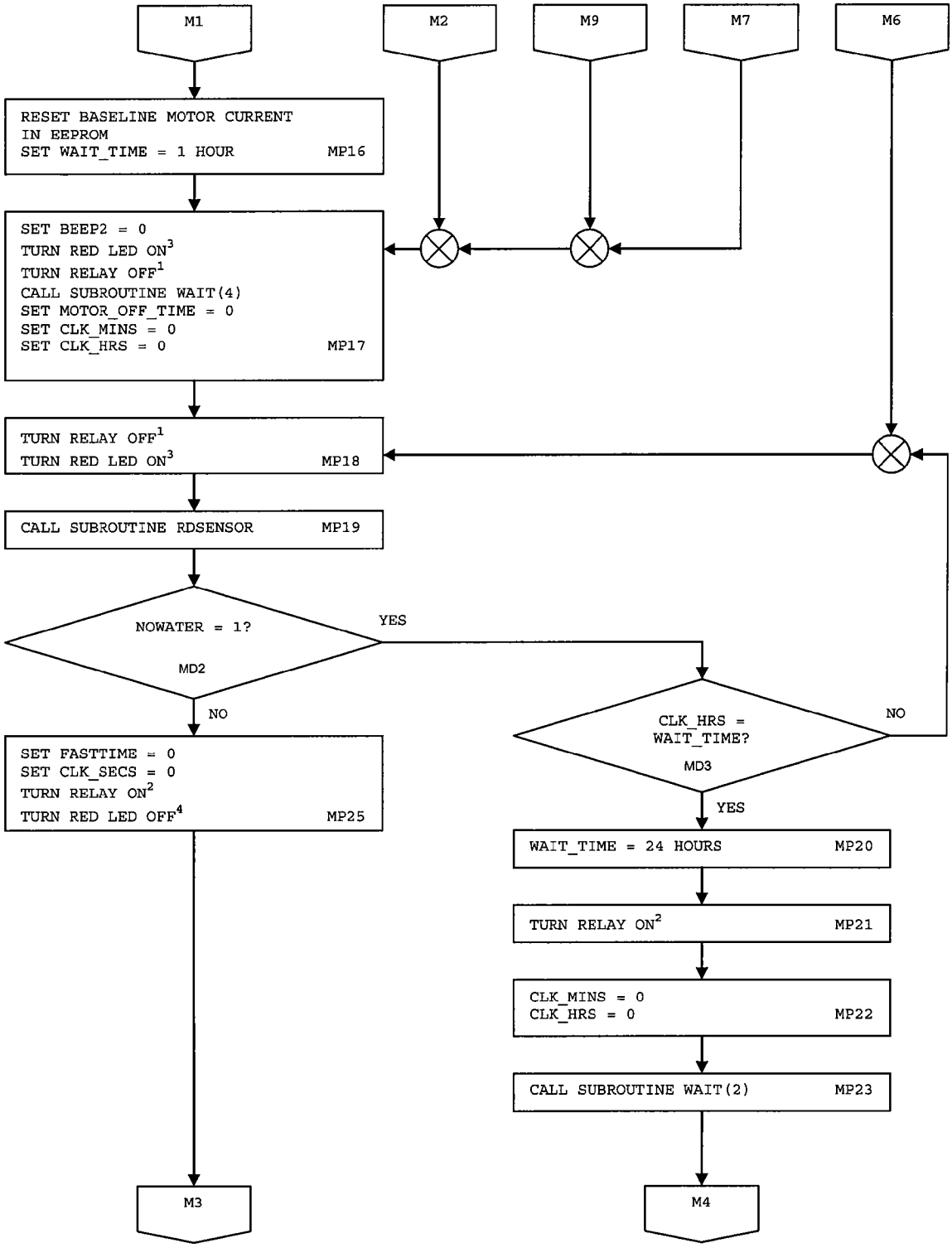
Figure 2.2

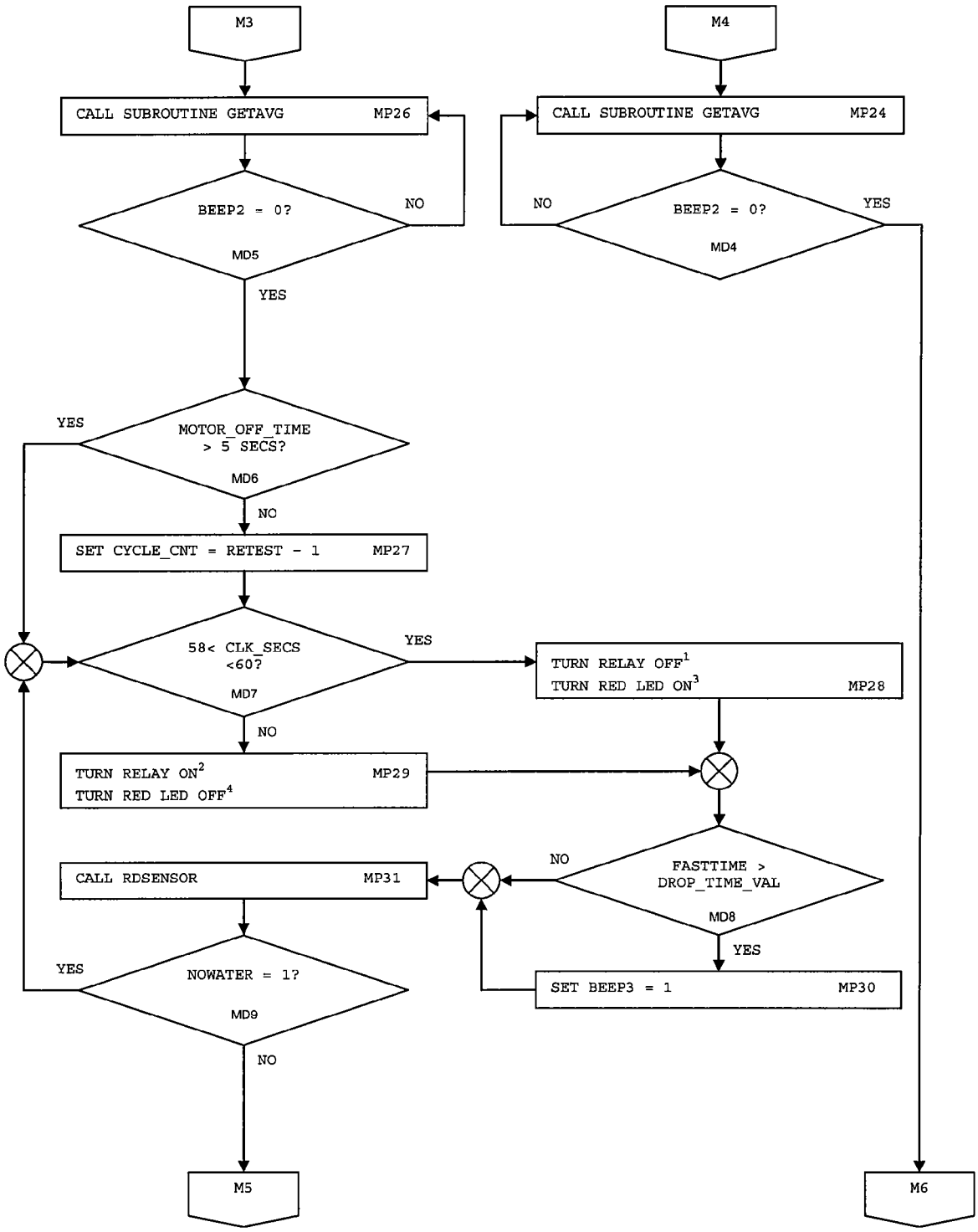
Figure 2.3

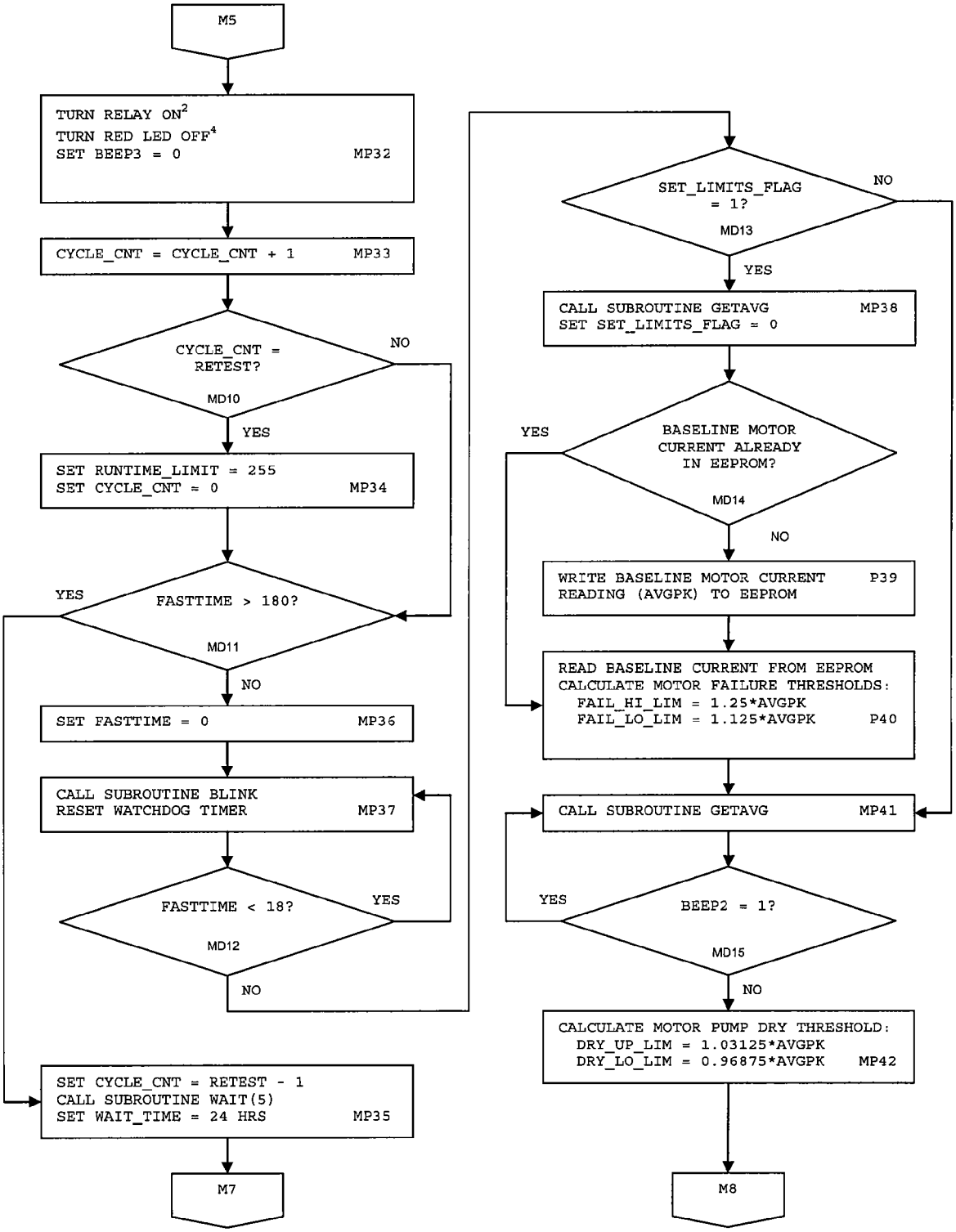
Figure 2.4

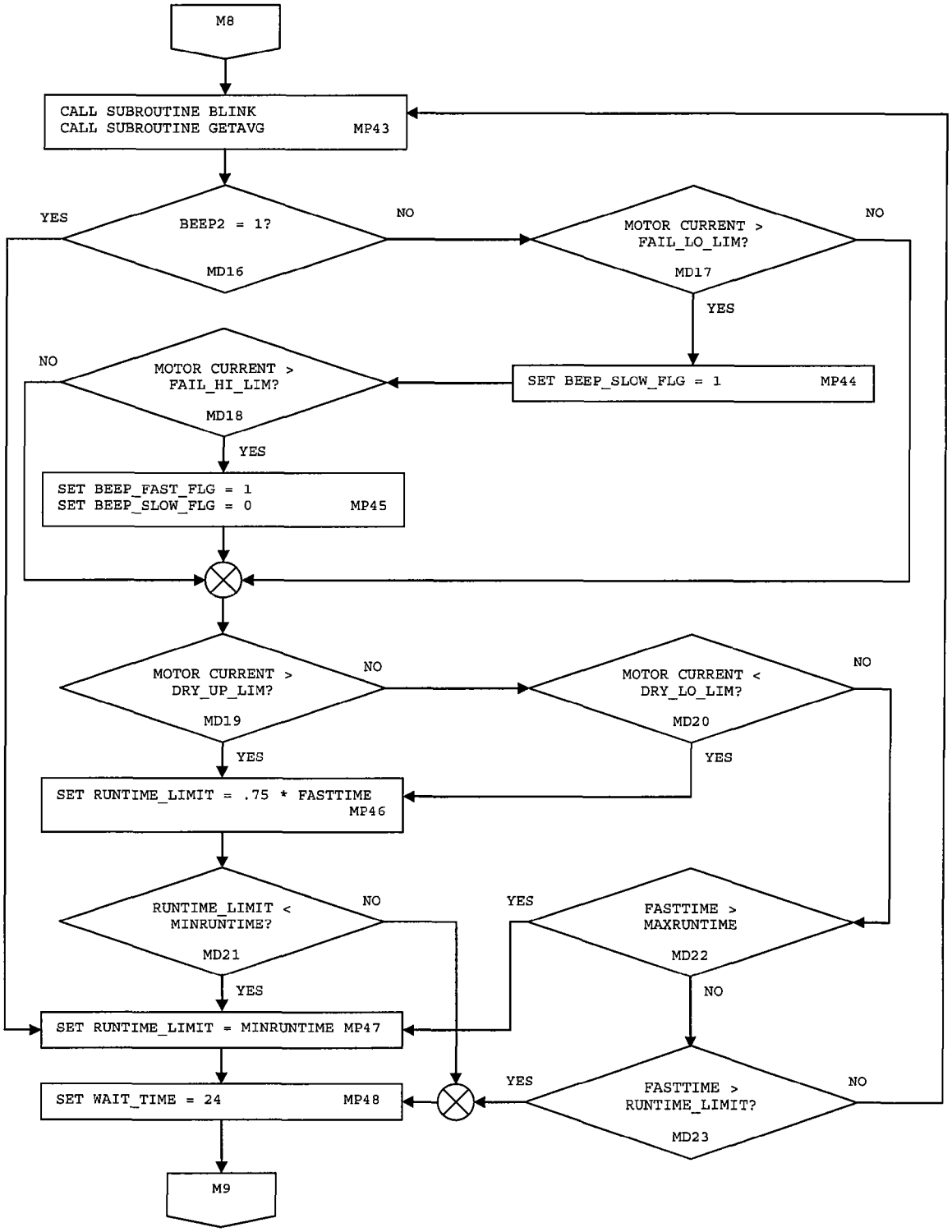
Figure 2.5

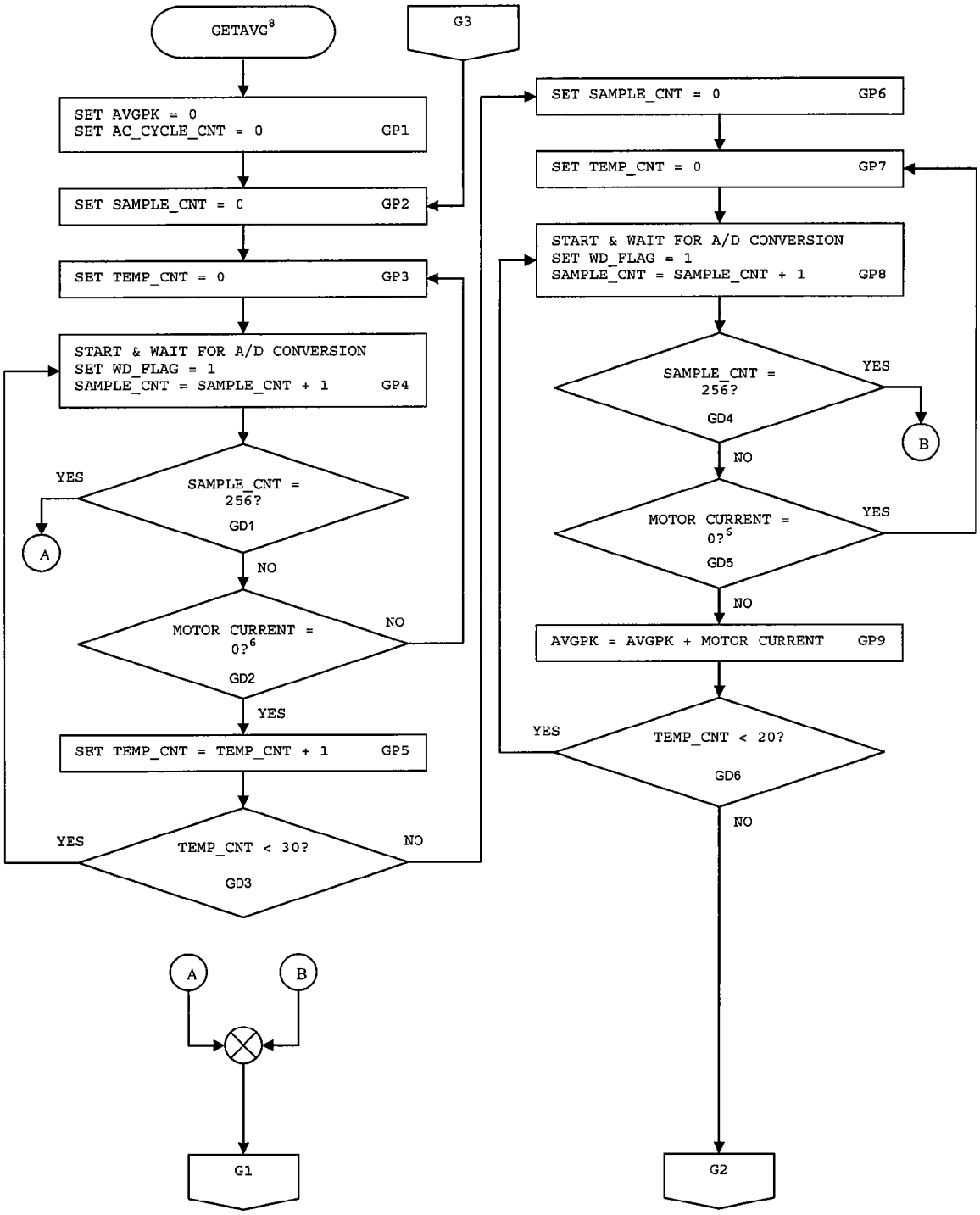
Figure 3.1

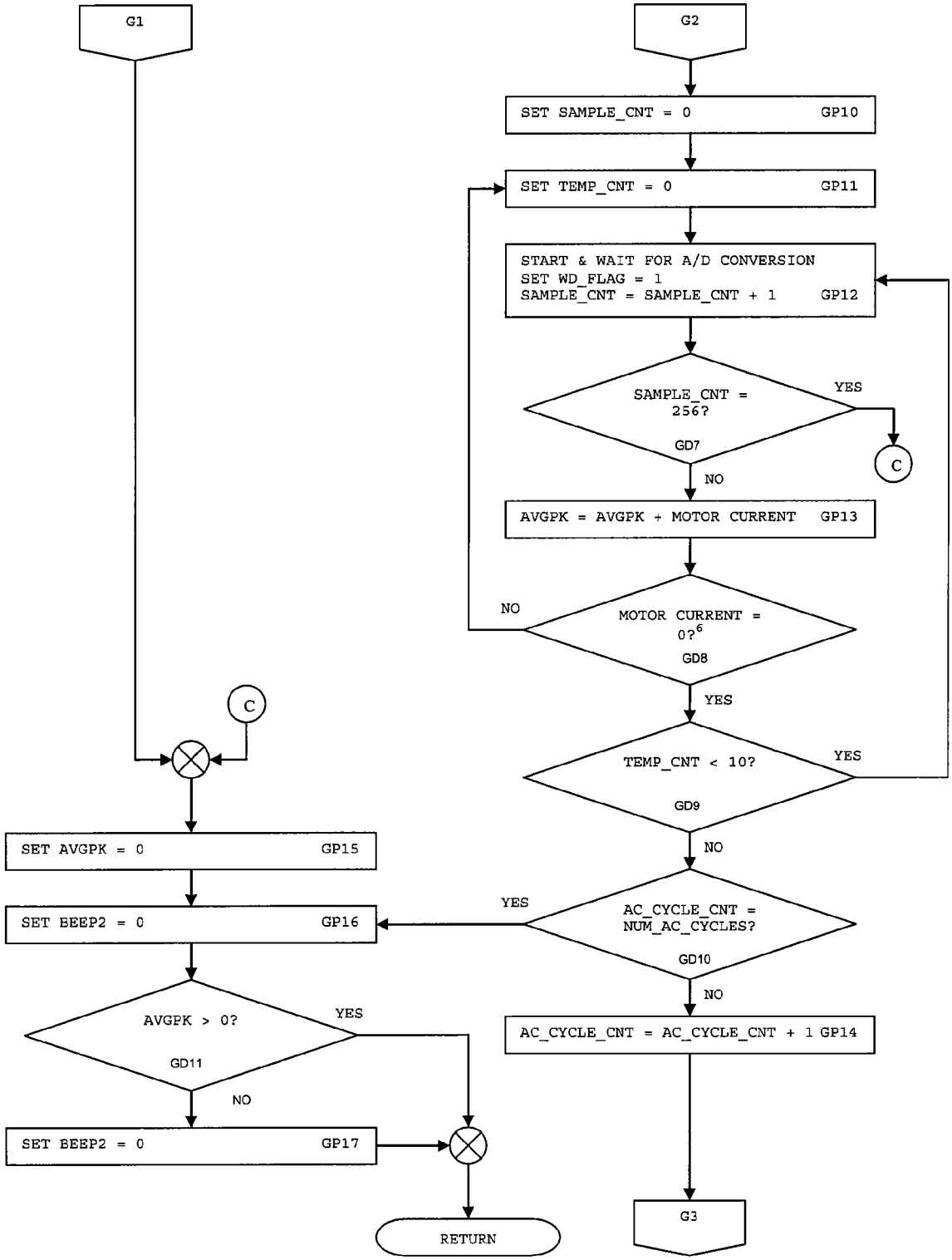
Figure 3.2

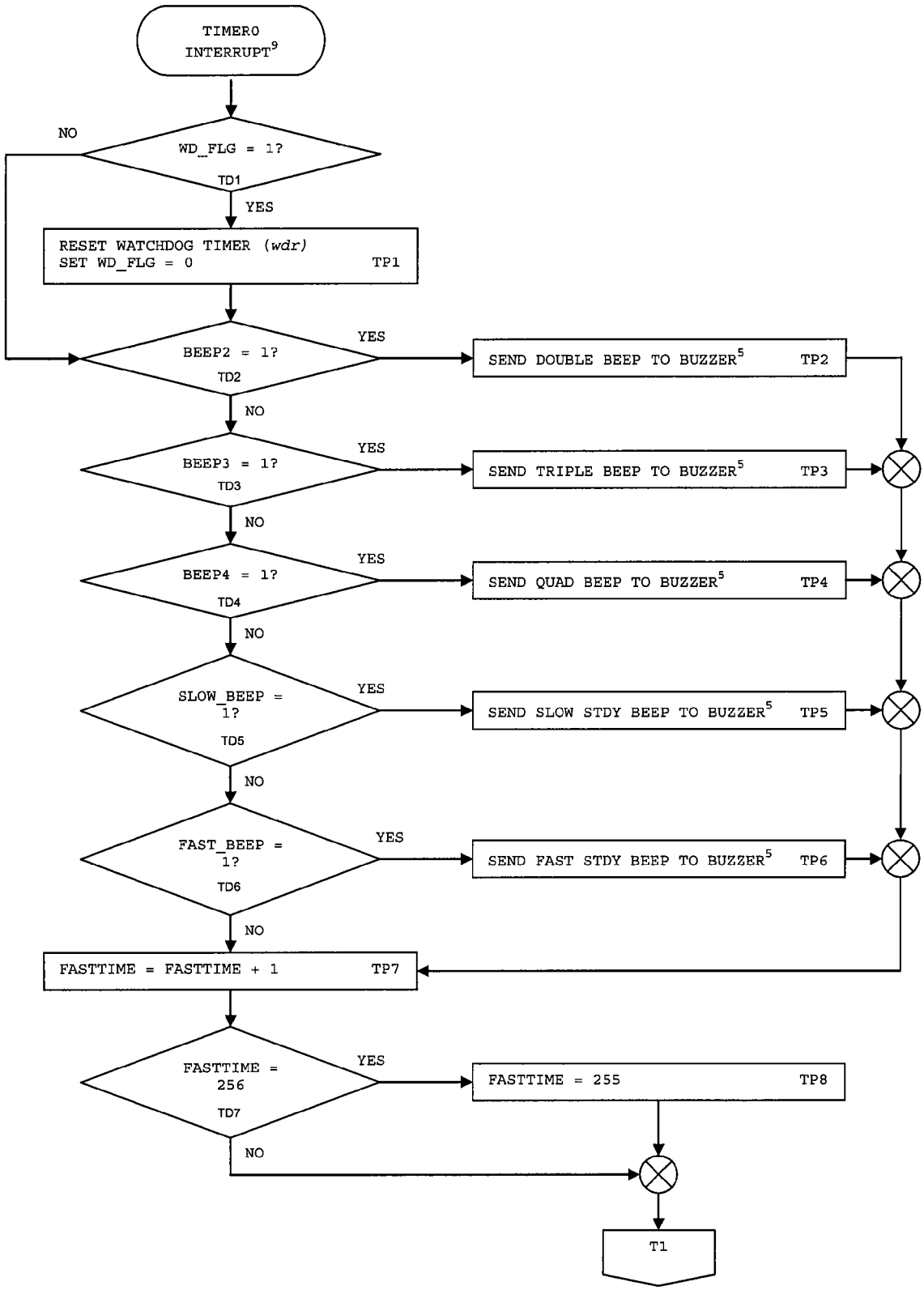
Figure 4.1

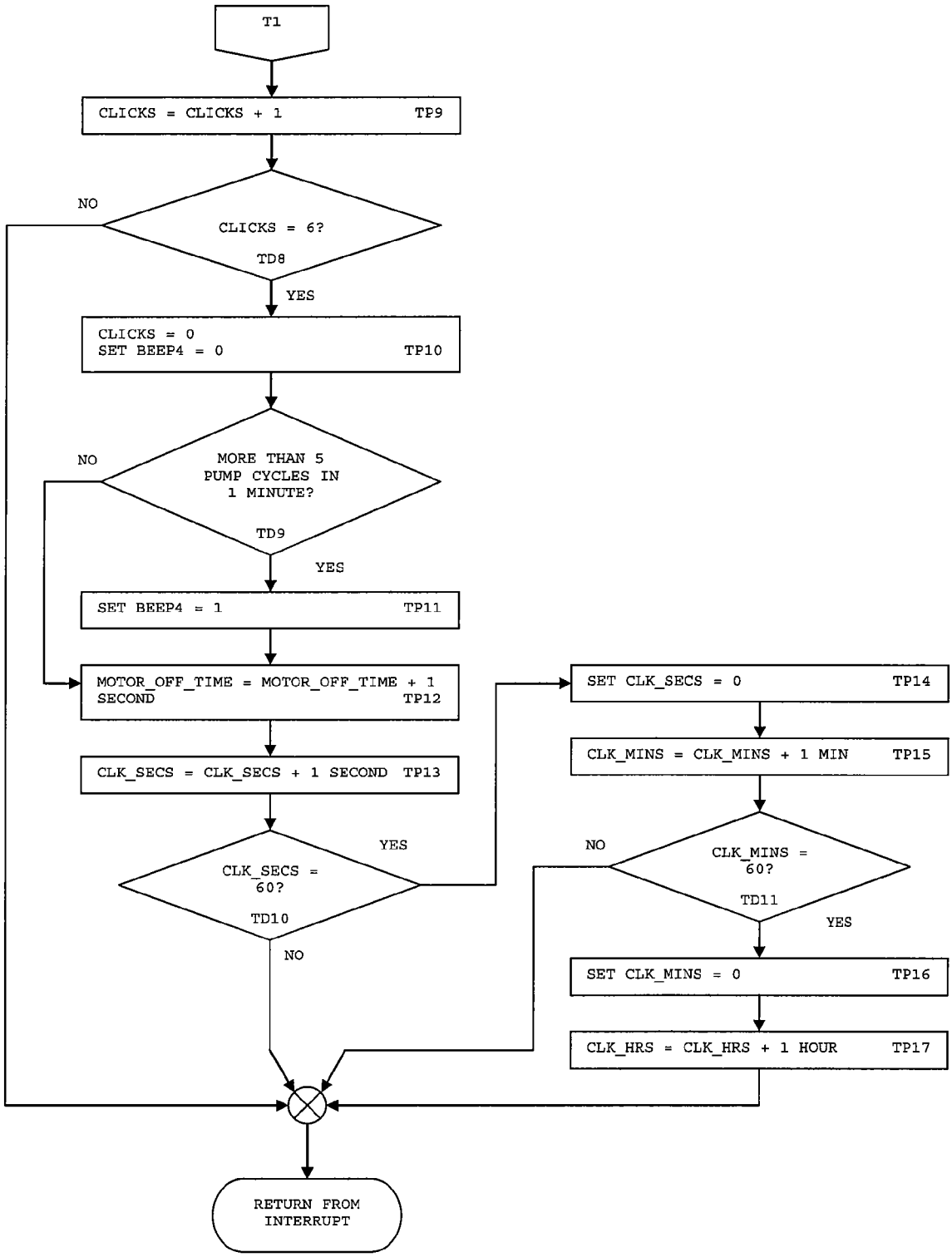
Figure 4.2

PUMP CONTROL APPARATUS, SYSTEM AND METHOD

CROSS-REFERENCE TO RELATED APPLICATION

This application claims the benefit of U.S. Provisional Patent Application Ser. No. 60/804,499, filed on Jun. 12, 2006, entitled "Electronic Sump Controller Device," the entire disclosure of which is fully incorporated herein by reference.

FIELD OF THE INVENTION

The present invention relates generally to the monitoring and control of a pump.

BACKGROUND

Drainage pumps are generally used for the drainage of accumulated liquid. One example, would be the drainage of water from a sump pit, which is commonly found in the basement of a house or other similar structure. The sump pit is simply a hole dug in the ground to collect water that enters a basement via perimeter drains funneling into the pit or from natural ground water in the earth. However, drainage pumps can also be used for removing liquid from ejector pits/systems, water collection wells, process water holding tanks, or the like.

Drainage pumps can be installed anywhere where flooding or liquid levels are seen as a problem. These pumping systems can be critical for pumping liquid to a location where it no longer presents a hazard. Given the important function provided by these pumps, there is a constant need to monitor and maintain the overall pump systems; particularly, if the pump is located in a harsh environment. Additionally, the lack of maintenance can drastically shorten the life of the pump or even require premature pump replacement.

More recent pump control systems include liquid level monitoring and alarm indication, which implement the use of mechanical and electronic floats. U.S. Pat. No. 4,187,503 to Walton and U.S. Pat. No. 6,149,390 to Fisher et al. are examples of systems that implement the use of mechanical floats. The mechanical floats sense the liquid level by being urged to a predetermined level in a sump pit by the rising liquid. Once the predetermined level is reached, an electrical contact is closed energizing an alarm circuit.

On the other hand, U.S. Pat. No. 5,314,313 to Janesky discloses the use of an electronic float. The electronic float includes two spaced apart electrodes placed at a predetermined level in the sump pit, wherein the rising liquid level provides the electrical connection between the electrodes thereby energizing the alarm circuitry. Although, these references appear to provide adequate alarm indications for undesirable water levels, they provide little monitoring and indication for protecting the pump and pump motor.

U.S. Pat. No. 5,324,170 and U.S. Pat. No. 5,545,012 both to Anastos et al. disclose pump monitoring and control systems. However, both of these systems are directed primarily to overcoming deficiencies in liquid level monitoring systems. For example, instead of using mechanical or electronic floats, these systems rely on monitoring certain operating characteristics of the pump to determine the presence of liquid in the sump pit. Power to the pump can then be controlled based on the results of this monitoring. Although these systems monitor operating characteristics of the pump, their primary purpose is to avoid the use of liquid level monitoring to control the operation of the pump. In fact, there is limited use of alarm indications for identifying adverse operating conditions that affect the operation of the pump and pump motor.

U.S. Pat. No. 6,676,382 to Leighton et al. is also directed to a pump monitoring control system that includes indications for certain operating conditions of a pump. However, similar to U.S. Pat. No. 4,187,503 to Walton and U.S. Pat. No. 6,149,390 to Fisher et al., the system here implements the use of a mechanical float. Therefore, a substantial amount of monitoring and alarming systems are used for detecting problems commonly associated with mechanical floats, not for protecting the pump or the pump motor.

Thus, there appears to be a need for improved monitoring, indication and control of a pump system.

SUMMARY

The present invention is directed to a pump control apparatus, system and method for more accurately determining pump and pump motor failures. In an embodiment of the invention, the apparatus includes a power circuit connectable to and controlling power for the pump. The power circuit includes a relay or switching device that is connectable to a controller, wherein the switch is regulated by the controller for controlling the power supplied to the pump.

Once the pump is energized, a current sensing circuit monitors the current flowing at the pump. The current sensing circuit includes a current transformer and a rectifier circuit. The current transformer is configured so that the current flowing through the current transformer is proportional to current flowing at the pump. The rectifier receives the current signal sensed at the current transformer and provides a rectified current waveform as an input to the controller.

The controller is connectable to and receives at least one input from the current sensing circuit and is configured to calculate, from the sensed current, a baseline operating current for the pump. The controller includes logic for calculating the baseline current value from the area under the rectified current waveform over four complete 50/60 Hertz cycles. The controller is also configured to determine, based on the calculated baseline current value, operating conditions that can adversely affect the operation of the pump. The controller may include a watchdog timer that resets the apparatus as required as well as logic for running periodic diagnostic checks or tests on the pump.

The apparatus also includes an alarm circuit connectable to and receiving at least one output from the controller. The alarm circuit provides alarm indications corresponding to the operating conditions determined by the controller, wherein there can be different alarm indications for different operating conditions. The operating conditions relate to at least improper pump operations and possible failure of the pump or pump motor. The alarm circuit can provide visual and audible alarm indications. The audible indication includes, for example, a buzzer with different audible patterns to indicate different operating conditions, and the visual indication can include a bi-colored LED that flashes different colors and patterns.

The apparatus further includes a level sensing circuit for sensing the liquid levels in a liquid collection area. The level sensing circuit also provides an input to the controller. The operating conditions identified by the controller can be based on a combination of the pump operating current and level indications in the liquid collection area, wherein the liquid collection area can be a sump pit, ejector pit/system, water collection well, process water holding tank or other similar system.

In another embodiment, the system of the present invention includes a power supply connectable to and providing the primary power to the pump; and a pump controller. The pump controller includes similar architecture of the apparatus of the present invention. For example, a power circuit for regulating a connection between the power supply and the pump; a current sensing circuit for monitoring the current flowing to the pump; and a central controller connectable to and receiving an input from the current sensing circuit, wherein the controller is configured to calculate a baseline operating current and a plurality of operating conditions affecting the operation of the pump.

The level sensing circuit includes an electrical sensor located at a predetermined level in a liquid collection area that establishes a complete electrical path with the other components of the level sensing circuit via an electrical connection with a pump or other ground. The electrical path is completed when the liquid level contacts the sensor. Additionally, an alarm circuit is connectable to and receives outputs from the controller, and provides alarm indications corresponding to the operating conditions determined by the controller.

The system also further includes a general computer system connectable to the pump controller for assisting in the implementation of the monitoring and control features of the present invention. For example, the computer system may be used to implement some or all of the main and subroutines for the monitoring and control of the pump.

In yet another embodiment, the method of the present invention includes sensing a liquid level, providing power to a pump, and sensing a first operating current flowing to the pump. A controller then calculates a baseline current value based on the sensed operating current. The baseline current value is used for calculating current thresholds. The current threshold accurately indicate failure of the pump or related pump systems e.g., the pump motor. The controller periodically compares a subsequent sensed operating current with the calculated current thresholds for determining operating conditions affecting the operation of the pump. Based on the results of the comparison, the controller can generate alarm indications for operating conditions affecting the operation of the pump.

The baseline current value is determined by measuring the area under a rectified current waveform over four complete 50/60 Hertz cycles, wherein the rectified current waveform is proportional to the current flowing at the pump. The baseline current is calculated by performing a discrete integration of the rectified current waveform over the four complete 50/60 Hertz cycles. The calculation of the baseline current value also includes synchronizing the start of the discrete integration with a leading edge of the rectified current waveform.

The method further comprising sensing a liquid level, and determining a plurality of operating conditions affecting the operation of the pump. Different alarm indications can be provided for the different operating conditions identified by the controller. The operation conditions are determined for a combination of improper pump operations and unacceptable liquid levels. The improper pump operations may include low current, no current or high current conditions measured at the pump during pumping operations. The unacceptable liquid levels may be based on levels sensed for a predetermined time, or based on a percentage change in operating current at the pump.

In still another embodiment, a computer program product is provided. The computer program product includes a computer-readable medium encoded with instructions that when executed by one or more processors perform the method of controlling the operation of a pump, as indicated above.

Additional features and advantages are described herein, and will be apparent from, the following Detailed Description and the figures.

BRIEF DESCRIPTION OF THE FIGURES

FIGS. 2.1 to 2.5 are logic flow diagrams of a main logic sequence or routine carried out by a microcontroller of the electronic controller device of FIG. 1.

FIGS. 3.1 to 3.2 are logic flow diagrams of a GET AVERAGE logic subroutine (GETAVG) called by the main routine of FIG. 2 as needed.

FIGS. 4.1 to 4.2 are logic flow diagrams of a TIMER0 OVERFLOW INTERRUPT logic subroutine called by the main routine of FIG. 2, as needed.

DETAILED DESCRIPTION

Figure 1:
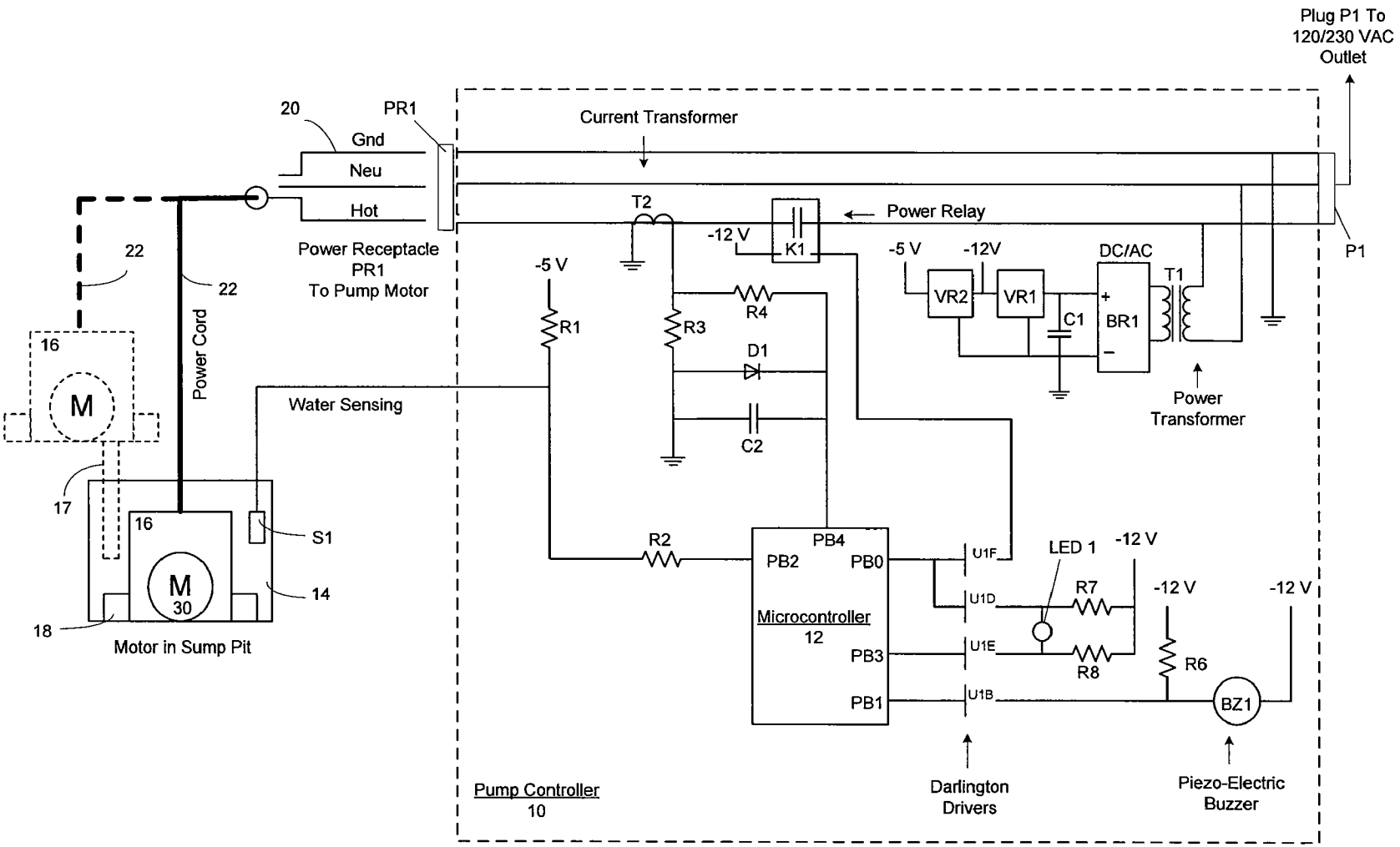
FIG. 1 is an exemplary circuit diagram showing components of the pump controller system according to an embodiment of the present invention.

FIG. 1 illustrates a block circuit diagram of an exemplary electronic pump controller system according to an embodiment of the present invention. In FIG. 1, the electronic pump controller system is implemented for a sump pump. However, it should be understood by one of ordinary skill in the art that this embodiment is meant to be exemplary, and that other systems are contemplated. For example, the electronic pump controller system of the present invention can also be implemented for ejector pits/systems, water collection wells, process water holding tanks, waste storage tanks, or in other similar commercial and industrial pumping operations.

In FIG. 1, a pump 16 is electrically connected to a pump controller 10. The pump 16 can be located inside or outside the sump pit 14. If the pump 16 is located outside the sump pit 14 (as indicated by the dotted lines), then a hose 17 can be extended into the sump pit 14 to assist in pumping the liquid. The pump controller 10 includes a plurality of interoperable subcircuits for controlling a pump 16. The subcircuits include a power supply subcircuit, a water sensing subcircuit, a current sensing subcircuit, a power switching subcircuit, an LED drive subcircuit, and a buzzer drive subcircuit. In one embodiment of the present invention, the structure and operation of the subcircuits are as follows.

The power supply subcircuit includes plug P1, transformer T1, bridge rectifier BR1, filter capacitor C1, voltage regulator VR1 and voltage regulator VR2.

The electronic controller 10 can be powered by plugging it into, for example, a 120/230 VAC outlet. When power is applied, current flows through the primary of transformer T1, which steps the current down to approximately 18 VAC. The stepped-down voltage at the secondary of transformer T1 is applied to bridge rectifier BR1, which converts the 60 Hz sine wave into a DC voltage. Capacitor C1 filters the DC voltage into a relatively ripple-free, but unregulated DC voltage at about 17 volts. This unregulated voltage is applied to voltage regulator VR1, which provides a regulated 12 volts DC at its output. The 12 volts DC is used by a number of components in the circuit and is fed to the input of voltage regulator VR2.

The voltage regulator VR2 acts as a step-down regulator, which converts the 12 volts DC into a regulated 5 volts DC to be used by a microcontroller 12 or microprocessor. For example, the microcontroller 12 can be of the type manufactured by Atmel Corporation of San Jose, Calif. and sold under part number ATtiny15L. The basic architecture of the ATtiny15L microcontroller can be found in Atmel literature entitled "8-bit AVR microcontroller with 1K byte Flash, ATtiny15L Summary," Rev. 1187FS-AVR-06/05, which is fully incorporated herein by reference.

Figure 8:
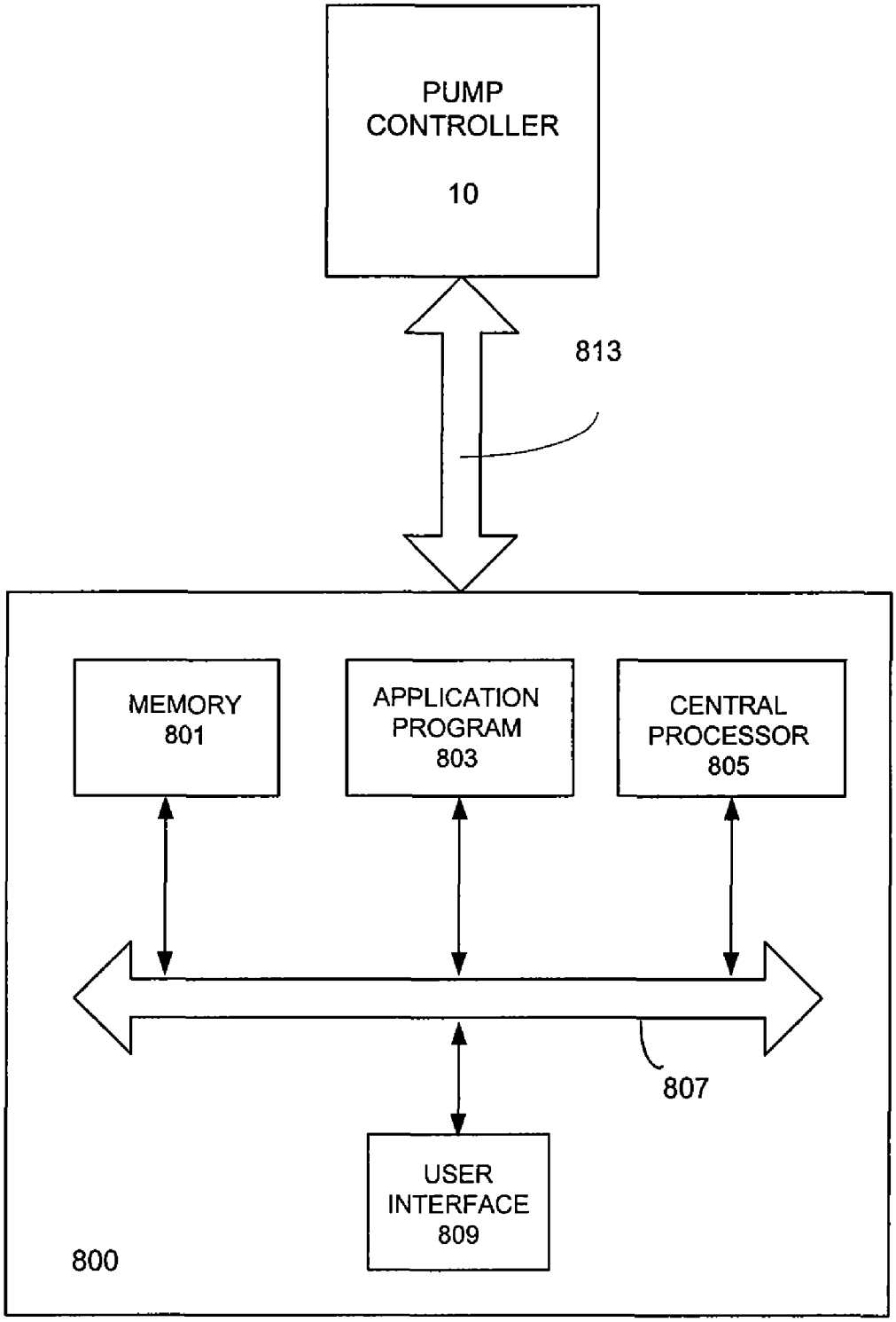
FIG. 8 is a sample computer system for monitoring and control of the pump in accordance with an embodiment of the invention.

In general, it should be appreciated that the microcontroller 12 contemplated by the invention includes at least programmable memory, general purpose registers, timer/counter, analog/digital converter, central processing unit, and arithmetic logic unit. Thus, the microcontroller 12 can be programmed to produce all desired operations. Additionally, in another embodiment the microcontroller 12 can be used in combination with a general computer system, as seen in FIG. 8. Those of ordinary skill in the art should also appreciate that other suitable microprocessors and computer systems may be used.

The water sensing subcircuit includes water sensor S1, resistor R1, resistor R2 and an analog to digital converter (not shown) that is part of the microcontroller 12. By way of example, R1 is 1 MΩ and R2 is 100 KΩ, wherein Ω is the resistance value (ohms) of an electrical resistor. One end of R1 is connected to the regulated 5 volts, the other end forms a junction with resistor R2 and the wire connected to sensor S1. The other end of resistor R2 is connected to input PB2 of the microcontroller 12. The function of R2 is to protect the PB2 input by limiting the maximum amount of current that can flow into it. The sensor S1 is located in a sump pit 14 with the pump 16, and its function is to sense the water level in the pit 14.

When the pit 14 is empty, no current flows through S1, R1 or R2, so PB2 sees an input of 5 volts. When water fills into the pit 14, the water will come in contact with sensor S1. When water does contact sensor S1, a low impedance path is created from the sensor S1 to the pump motor ground (not shown), which is connected to circuit ground through the connection of the motor power plug to power receptacle PR1. This path allows current to flow from the 5 volt supply, through resistor R1, through the sensor S1 to the pump, and circuit ground. This current flow creates a voltage drop across R1 which is detected by the analog to digital converter in the microprocessor 12. The actual voltage present at PB2 will depend on a number of factors, but will generally be lower than 5 volts.

The current sensing subcircuit includes current transformer T2, resistors R3 and R4, diode D1 and capacitor C2. Current transformer T2 is arranged such that current flowing to a pump motor 30 also flows through the primary of T2. One end of the secondary of T2 is connected to circuit ground and the other forms a junction with T2, R3 and R4. By way of example, R3 is 150Ω, R4 is 10 KΩ and C2 is 0.1 μF, wherein F represents the capacitive value (farads) of an electrical capacitor. The other end of R3 is connected to circuit ground, and the other end of R4 forms a junction with R4, D1, C2 and input PB4 of the microcontroller 12. Both D1 and C2 have one lead connected to circuit ground.

When current flows through the primary of T2, a voltage is produced at its secondary. The magnitude of this voltage is dependent on both the level of the primary current and the size of burden resistor R3. R3 is sized so that T2 produces a peak voltage of 5 volts at a primary current of 15 amps. resistor R4 serves two functions. Resistor R4 protects input PB4 of microcontroller 12 by limiting the amount of current that can flow into it, and it forms a low pass circuit with capacitor C2, which removes transient voltages from the signal at input PB4. Diode D1 protects input PB4 from reverse polarity voltages.

The power switching subcircuit includes output PB0 of microcontroller 12, Darlington driver U1F and relay K1. When output PB0 is high, it drives the input to U1F causing the transistors to turn on and the output to sink current, which energizes the coil of K1. When relay K1's coil is energized, its contacts close, allowing current to flow to a pump motor 30. When PB0 drops low, relay K1 is de-energized and its contacts open, removing power to the pump motor 30.

LED1 is a Bi-Color light emitting diode (LED), capable of showing Green or Red when activated. The LED drive circuit includes Darlington drivers U1D and U1E, LED1, and resistors R7 and R8. By way of example, resistor R7 is 470Ω and resistor R8 is 470Ω. The input to Darlington driver U1D is also connected to output PB0 of microcontroller 12, and driver U1E is connected to microcontroller 12 output PB3. The output of U1D forms a junction with one side of LED1 and one end of resistor R7. The other end of R7 is connected to the regulated 12 volt supply. The input to Darlington driver U1D is connected to output PB0 of microcontroller 12.

The output of the driver U1E forms a junction with the other side of LED1 and one end of resistor R8. The other end of resistor R8 is also tied to the 12 volt supply. When the microcontroller 12 sets PB0 high and PB3 low, the output of U1D is turned on and the output of U1E is turned off. Current will flow through the green half of LED1, emitting green light. When the microcontroller 12 sets PB3 high and PB0 low, U1D will turn off and U1E will turn on, causing current to flow through the red half of LED1, emitting red light.

The buzzer drive subcircuit includes Darlington driver U1B, resistor R6 and piezo-electric buzzer BZ1. The input of U1B is connected to output PB1 of microcontroller 12. The output of U1B forms a junction with one end of resistor R6 and one side of buzzer BZ1. By way of example, resistor R6 is 1 KΩ. The other end of resistor R6 is connected to the 12 volt supply, and the other side of BZ1 is also connected the 12 volt supply. In operation, when the microcontroller 12 determines an alarm should be sounded, it will turn output PB1 on and off at a frequency equal to the resonant frequency of BZ1. The output is in the form of a square wave. This signal causes U1B to turn on and off at the same resonant frequency. When the turned on, U1B will sink current both through Buzzer BZ1 and Resistor R6. When turned off, it will no longer sink current, and allow resistor R6 to source current to buzzer BZ1, resulting in both sides to be at the 12 volt voltage level. This repeated changing in bias causes the buzzer to resonate and emit an audible tone.

In one embodiment, the present invention further includes a grounded housing 18 associated with the pump 16. Also included with the pump 16 is a pump power cord 22 having a ground lead 20 electrically connected to the motor 30 in the sump pit 14 and connectable to the power receptacle PR1. In an embodiment, the electronic controller device 10 controls pump 16 operation as follows.

When the pump controller device 10 is first powered on, an output relay K1 is energized to measure load current via current transformer T2. If microcontroller 12 detects a load, no action is taken. If no load is detected, the microcontroller 12 resets its internal registers to factory defaults. If no load is detected on the output of output relay K1 for a certain time period (e.g., after one hour of having power applied to the sump controller device 10), the microcontroller 12 sounds a buzzer BZ1 to alert a user of a problem.

Additionally, as the water level rises in the sump pit 14, the water intermittently comes into contact with the water sensor S1. Water contact with the sensor S1 completes an electrical circuit from a 5V supply, through pull-up resistor R1, through the sensor wire of the water sensor S1, through the water in the sump pit 14, through a grounded housing 18 of the pump 16, through a ground lead 20 of the pump power cord 22, and to circuit ground. The current flowing through this circuit causes a voltage drop across resistor R1. This voltage drop is detected by the microcontroller 12 and it subsequently turns on output relay K1, energizing the motor 30 of the pump 16 and draining the sump pit 14 until the water level drops below the sensor S1. When the water level drops below the sensor, the complete circuit path is opened thereby stopping current flow through the grounded housing 18.

In one embodiment, the first time the motor 30 of the pump 16 is energized to drain the sump pit 14 and every 150th cycle thereafter, the microcontroller 12 runs the pump 16 until it sees a ±3.5% change in motor load current, indicating that the pump 16 has switched from pumping water to air. To detect the change in current reliably, the microcontroller 12 measures an area under a rectified current curve for 4 complete 50/60 Hz cycles. The microcontroller 12 records the time between the water sensor S1 no longer detecting water (because the pump 16 is draining the sump pit 14) and when the ±3.5% change in motor 30 load current occurs. This value is then reduced by twenty-five percent (25%) of its original value, with a minimum allowed value of four seconds. The resultant value is used as the nominal run time for the 2nd, 3rd, etc. cycles. Also during this first cycle, the microcontroller 12 reads and stores a baseline current value equal to the area under the curve of four 50/60 Hz cycles. This baseline is used by the microcontroller 12 to detect impending motor 30 failures, indicated by an abnormal rise in current load.

For each subsequent time the motor 30 of the pump 16 is energized to drain the sump pit 14, the microcontroller 12 compares the current level to a baseline current level determined in the same manner as described above. If a current rise between 25% and 50% is detected, the microcontroller 12 activates the buzzer BZ1 at about a 1 Hz rate to indicate the problem. If a 50% or greater increase in current is detected, the buzzer BZ1 activates at about a 2 Hz rate.

Twenty four hours after the last time the pump 16 ran, the microcontroller 12 attempts to energize the pump 16 by turning on output relay K1. If an attached load is detected nothing occurs, but if no load is detected the buzzer BZ1 is activated to indicate a user of a problem.

If the electronic sump controller device 10 is triggered by water level rising to the level of the water sensor S1 in the sump pit 14 and the water level does not drop below the water Sensor S1 within 15 seconds thereafter, the sump controller device 10 sounds an alarm by activating buzzer BZ1. The buzzer indicates to a user that the sump pit 14 is not being drained by the pump 16.

FIGS. 2.1 to 2.5 illustrate a main logic routine carried out by the microcontroller 12 according to an embodiment of the present invention. The main logic routine includes a plurality of process steps and decisions, beginning with process step MP1. Process step MP1 includes a WatchDog Timer, which in the embodiment described, is preprogrammed for a period of 2048K CPU (microprocessor 12) clock cycles, or about 2 seconds. The counter of the microcontroller 12 is reset whenever a wdr (Watch Dog Reset) instruction is executed. If the timer reaches a maximum value, i.e. no wdr instructions are executed, a hardware reset of the CPU is performed. The WatchDog timer prevents the Microprocessor 12 from getting caught in an infinite loop.

In process step MP2, the following flags are set to their initial states for the following purposes. When BEEP2 is set, it results in a double-beep pattern being sent to the buzzer BZ1. BEEP2 is set whenever the output relay K1 has been energized but no current to the motor 30 is detected. It is reset whenever a load is detected. When BEEP3 is set, it results in a triple-beep pattern to be sent to the buzzer BZ1. BEEP3 is set if the output relay K1 has been turned on and a current load has been detected, but the water sensor S1 is still detecting water after a period of 15 seconds. When BEEP4 is set, it results in a four-beep pattern being sent to the buzzer BZ1. BEEP4 is set when there are 5 or more on/off cycles of the pump 16 in a 60 second period. The BEEP4 flag is reset if there are less than 5 cycles in a 60 second period.

When FASTFLAG is set it sends a fast, steady beep pattern to buzzer BZ1. FASTFLAG is set when the motor 30 current is measured to be 50% above the stored initial motor 30 current reading and reset when the motor 30 current is measured to be less than 150% of the baseline current described above. SETLIMITSFLAG is used to determine if the motor 30 failure current thresholds have been set. If SETLIMITSFLAG is set, new threshold values are calculated (see process step MP41) and then reset. If SETLIMITSFLAG is reset, no new values are calculated. SLOWFLAG is a flag that when set will send a slow but steady beep pattern to buzzer BZ1. The SLOWFLAG is set if the motor 30 current is measured to be 25% above the initial current reading and reset when the measured current drops below 125% of the baseline current described above. WD_Flag (Watch Dog Flag) is a flag that is set to 1 at various points during the execution of the program. The state of the flag is checked in the TIMER0 Overflow Interrupt subroutine. If the flag is set (=1) then a wdr instruction is executed, resetting the WatchDog Timer. If the flag is reset (=0) then the wdr instruction is not executed and the WatchDog Timer is allowed to continue timing.

In process step MP3, the Port B I/O bits on the microprocessor 12 are initialized as follows. PB0 is configured as an output and is used to turn the output relay K1 and the Green half of LED1 on & off. PB1 is configured as an output used to drive the buzzer BZ1. Internally, PB1 is connected to the output of the TIMER1 compare register. PB2 is configured as an input and is connected through resistor network R1 & R2 to the Sensor. PB3 is configured as an output and is used to turn the Red half of LED 1 on & off. PB4 is configured as an input and is connected internally to the microprocessor 12 to the A/D Converter. PB5 is configured as an input but is not used.

In process step MP4, the PB0 bits configured as outputs are initialized to the following state. PB0 is turned off, removing the drive from Darlington transistors U1F, de-energizing relay K1 and U1D, turning off the Green half of LED1. PB1 is turned off, removing the drive to Darlington transistor U1B and turning off buzzer BZ1. PB3 is turned on, turning on the Red half of LED1. In process steps MP5 to MP7, initializing operation for the Microprocessor 12 is executed and includes the following steps: disabling the internal resistor pull-ups on the I/O pins, configuring the microcontroller sleep mode, setting A/D conversion parameters, interrupting when conversion is completed, setting the Clock cycle equal to 100K Hz, fine tuning an on-board oscillator by reading calibration byte from EEPROM, and writing calibration register.

In process step MP8, the initializing of Timer1 is performed, which includes configuring internal timer Timer1 to count from 0 to preset value, resetting and repeating, setting compare register to 195, and generating a 4,100 Hz square wave output used to drive buzzer BZ1 at its resonant frequency. In process step MP9, the initializing of TIMER0 is performed, which includes configuring internal timer TIMER0 to interrupt on overflow and select the pre scale value of 1024 to give an input clock frequency of 1,562.5 Hz.

In process step MP10, the following program variables are set to their initial values. The RETEST variable is set to 150. This constant is used to determine how many timed cycles are run before a calibration cycle is run. The CYCLE_CNT variable is set to RETEST minus 1. This variable is incremented every time the motor 30 is turned on and is used to determine when a calibration cycle is to be run. The DROP_TIME_VAL variable is set to 15. This constant is used as the alarm limit, in seconds, when timing how long it takes, once the motor 30 has been turned on, for the water to drop below the water sensor S1. If it takes longer than DROP_TIME_VAL minutes for the water to drop below the sensor S1, the three-beep pattern is sent to the buzzer BZ1. The NUM_AC_CYCLES is set to 4. This variable is used to define the number of complete cycles to use when measuring the motor 30 current.

The WAIT_TIME variable is set to 24. This variable is used to determine how long to wait, in approximate hours, before testing whether a load is connected or not. The THRESHOLD variable is set to 3.25 VOLTS. This variable is used to determine if water is detected by the sensor S1. If the voltage at PB2 is above THRESHOLD, then there is no current drop across resistor R1 so there is no water in the pit 14. If the voltage at PB2 is below THRESHOLD, then there is a voltage drop across resistor R1 and there is water in the pit 14. The variable MAXRUNTIME is set to 30. This variable is used to set the maximum amount of time, in approximate seconds, the sump motor 30 will be allowed to run once the water drops below the level of the sensor S1. The MINRUNTIME is set to 4. This variable is used to set the minimum amount of time, in approximate seconds, the sump motor must run once the water drops below the level of the sensor S1.

In process step MP11, subroutine BEEP1 is called, which triggers a single beep being sent to the buzzer BZ1. In process step MP12, PB0 is set to 1, which drives the input to Darlington transistor U1F, turning on the output and letting current flow through the coil of relay K1 and energizing it. PB0 also drives the input to U1D, which turns on a green half of LED1.

In process step MP13, a call to subroutine WAIT with variable TEMP set equal to 2 is executed, which results in a 2 second delay before the next process step is executed. In process step MP14, a call to subroutine GETAVG puts a numeric value corresponding to the motor 30 current into variable AVGPK. If GETAVG detects that AVGPK has a value greater than 0 it will set flag BEEP2 to zero. If AVGPK is zero, then flag BEEP2 will be set to 1.

In process step MP15, PB0 is set to 0, which drops the input to Darlington transistor U1F, turning off the output and stopping the current flow through the coil of relay K1, de-energizing it. Setting PB0 to 0 also turns off the input to transistor U1D, which turns off the green half of LED1.

The value of BEEP2 is tested in MD1. If BEEP2 is equal to 0, then a load is attached, jumping to process step MP17. If BEEP2 is equal to 1, no load is attached and the routine continues with process step MP16. In process step MP16, the numeric value in EEPROM that represents the "normal," or baseline, current draw of the motor is set to 0. Resetting triggers a new reading to be taken and stored in EEPROM. Also, WAIT_TIME is set to 1 hour instead of 24 hours.

In process step MP17, BEEP2 is reset to 0 and the time-of-day clock is set to zero by setting CLK_SECS, CLK_MINS, and CLK_HRS to zero. Also, PB0 is set to 0, which causes relay K1 to de-energize, and the green half of LED1 to turn off. Set PB3 to 1, which causes the red half of LED1 to turn on. MOTOR_OFF_TIME is also set to zero and call WAIT with variable TEMP is set to 4, which will result in a 4 second delay before the next process step is executed.

In process step MP18, PB0 is set to 0, which causes relay K1 to de-energize, and the green half of LED1 to turn off. Also, in process step MP18, PB3 is set to 1, which causes the red half of LED1 to turn on. In process step MP19, The call to subroutine RDSENSOR will cause the flag NOWATER to be set to 1 if no water is detected by the sensor S11, or set to 0 if water is detected.

In decision MD2, the state of flag NOWATER is checked. If it is equal to 1, then no water has been sensed and the process continues to decision MD3. If NOWATER is equal to 0, then water has been sensed and the routine jumps to process step MP25. In decision MD3, CLK_HRS is compared to the value in WAIT_TIME. If not equal, loop back to process step MP18. If equal, then it is time to check if a load is connected, and continue with process step MP20.

A check for an attached load is performed in process steps MP20 to MP23. First, WAIT_TIME is reset to 24 hours, which triggers another check for attached load 24 hours from this check. PB0 is set to 1, which caused relay K1 to energize. The time-of-day clock is reset by setting CLK_MINS and CLK_HRS to 0. Finally, call subroutine WAIT with variable TEMP is set to 2, which delays the execution of the next process step by 2 seconds, thereby allowing the relay and any connected load to stabilize. The routine then continues to process step MP24. In process step MP24, the call to subroutine GETAVG puts a numeric value corresponding to the motor 30 current into variable AVGPK. If GETAVG detects that AVGPK has a value greater than 0, it sets flag BEEP2 to zero. If AVGPK is zero, then flag BEEP2 will be set to 1. The routine then continues to decision MD4.

In decision MD4, the state of flag BEEP2 is checked. If it is reset (equal to 0), then a load is attached and the routine is looped back to process step MP18. If BEEP2 is set (equal to 1), no load is attached and the routine is looped back to process step MP24. In process step MP25, the relay is turned on and the red LED is turned off. First PB0 is set to 1, which drives the input to Darlington transistor U1F, turning on the output and letting current flow through the coil of relay K1, energizing it. PB0 also drives the input to U1D, which turns on the green half of LED1. Also, PB3 is set to 0, which causes the red half of LED1 to turn off. Variables CLK_SECS and FASTTIME are set to 0. The variable CLK_SECS is incremented in interrupt subroutine TIMER0 when CLICKS reaches 6, which is roughly once every second. The variable FASTTIME is also incremented in interrupt subroutine TIMER0 approximately every 164 milliseconds and used for various timing functions by the main routine.

In process step MP26, a call to subroutine GETAVG puts a numeric value corresponding to the motor 30 current into variable AVGPK. If GETAVG detects that AVGPK has a value greater than 0, flag BEEP2 is set to zero. If AVGPK is zero, then flag BEEP2 will be set to 1. The routine then continues to decision MD5. In decision MD5, the state of flag BEEP2 is checked. If it is reset (equal to 0), then a load is attached and the routine continues to decision MD6. If BEEP2 is set (equal to 1), no load is attached and the routine loops back to process step MP26.

In decisions MD6, the value of MOTOR_OFF_TIME is checked. If it is less than 5 seconds, the next cycle is set to a calibration cycle (process step MP27). If MOTOR_OFF_TIME is greater than 5 seconds, the routine jumps to decision MD7. In process step MP27, the CYCLE_CNT is set to RETEST −1. This forces a calibration cycle to be run. The routine then continue to decision MD7. In decision MD7, CLK_SECS is checked to see if it is between 57 and 60. If it is, then motor 30 will be turned off for 2 seconds (process step MD28). If not, the routine continues with process step MP29. Turning the motor 30 off for 2 seconds allows a check of the sensor S1 state without the motor 30 being on, eliminating any motor 30 induced noise from giving a false reading of water level.

In process step MP28, PB0 is set to 0 causing relay K1 to de-energize and the green half of LED1 to turn off. PB3 is set to 1 causing the red half of LED1 to turn on. The routine jumps to decision MD8. In process step MP29, PB0 is set to 1, causing relay K1 to energize and the Green half of LED1 to light. PB3 I set to 0, turning off the Red half of LED1. The routine then continues to decision MD8.

In decision MD8, FASTTIME is compared to DROP_TIME_VAL. Variable FASTTIME was set to 0 when the pump was initially turned on (process Step MP25) and therefore holds a time value equal to the amount of time the motor 30 has been running. If the motor 30 has been on longer than the limit stored in DROP_TIME_VAL, then a triple-beep pattern is sent to buzzer BZ1 (Process Step MP30) If not, the routine jumps to process step MP31. In process step MP30, BEEP3 is set to 1, causing a triple-beep pattern to be sent to buzzer BZ1. The routine then continues to process step MP31.

In process step MP31, a call to subroutine RDSENSOR causes the flag NOWATER to be set to 1 when no water is detected by the sensor S1, or set to 0 when water is detected. In decision MD9, the state of flag NOWATER is checked. If it is equal to 1, then no water has been sensed and the routine loops back to decision MD7. If NOWATER is equal to 0, then water has been sensed. The routine then continues to process step MP32. In process step MP32, PB0 is set to 1 (turning on relay K1) and PB3 is set to 0 (turning the red half of LED1 off). This step is performed in case the loop was broken when CLK_SECS was between 57 and 60. Additionally, BEEP3 is set to 0, turning off triple-beep pattern. The routine then continue to process step MP33.

In process step MP33, CYCLE_CNT is set to CYCLE_CNT plus 1. CYCLE_CNT is a counter incremented every time the motor 30 is turned on. In decision MD10, CYCLE_CNT is checked to see if it equals RETEST. If it does, then the current cycle will be a calibration cycle, and processing will continue with process step MP34. If it doesn't, then the current cycle is a "timed" cycle and processing continues at process decision MD11.

In process step MP34, RUNTIME_LIMIT is set to 255. RUNTIME_LIMIT holds the run time value, in approximate seconds, used for "timed" cycles. Setting RUNTIME_LIMIT equal to 255 flags a calibration cycle. The CYCLE_CNT is also reset to 0. In decision MD11, FASTTIME is compared to the value 180. If FASTTIME greater than 180, then it took longer than 30 seconds for the water to drop below the level of the Sensor S1. If this is the case, then the current cycle is set for 5 seconds and next cycle is a calibration cycle (Process Step MP35). If FASTTIME is less than 180 seconds, the routine jumps to process step MP36.

In process step MP35, CYCLE_CNT is set to RETEST minus 1. This forces the next cycle to be a calibration cycle. Subroutine WAIT is called with variable TEMP set to 5. This causes a 5 second delay before the next process step is executed. WAIT_TIME is set to 24 and the routine loops back to process step MP17. In process step MP36, FASTTIME is set equal to 0 and the routine continues with process step MP37. In process step MP37, subroutine BLINK is called, which causes the green LED to blink at a slow rate, about once per second, if cycle is a timed cycle, and at a fast rate, about twice per second, if cycle is a calibration cycle. Also, a wdr instruction to reset the Watchdog Timer is executed.

In decision MD12, the value in FASTTIME is compared to 18. If the value is less than 18, then the routine loops back to process step MP37. If it is greater than 18, then the routine continues to decision MD13. Looping until FASTTIME equals 18 results in an approximate 3 second delay before reading motor 30 currents, which allows for startup inrush currents to stabilize.

In decision MD13, the state of flag SETLIMITSFLAG is checked. If set, FAIL_UP_LIM and FAIL_LO_LIM have already been calculated and the routine jumps to process step MP42. If not set, then limits have to be calculated. The routine then continues with process step MP38. In process step MP38, SETLIMITSFLAG is set to 1, indicating that FAIL_UP_LIM and FAIL_LO_LIM have been calculated. The subroutine GETAVG is called, putting a numeric value corresponding to the motor 30 current into variable AVGPK.

In decision MD14, the value representing baseline motor 30 current from EEPROM is read. If the value read equals zero, then the new value is written to EEPROM (process step MP40). If the value is not zero, then the routine jumps to process step MP39. In process step MP39, the value of AVGPK obtained in process step MP38 is written to EEPROM. In process step MP40, the value representing baseline motor 30 current from EEPROM is read. FAIL_UP_LIM is set to 1.50 multiplied by baseline current, and FAIL_LO_LIM is set to 1.25 multiplied by baseline current.

In process step MP41, the call to subroutine GETAVG puts a numeric value corresponding to the motor 30 current into variable AVGPK. In decision MD15, the state of flag BEEP2 is checked. If reset (equal to 0), then a load is attached and the routine continues to process step MP42. If BEEP2 is set (equal to 1), no load is attached and the routine is looped back to Process Step MP41. In process step MP42, transition thresholds are calculated. In one embodiment, a change in the initial motor 30 current reading of ±3.125% indicates the transition from pumping water to sucking air. Therefore, the DRY_UP_LIM is set to 1.03125 multiplied by AVGPK (AVGPK obtained in process step MP41) and the DRY_LO_LIM is set to 0.96875 multiplied by the AVGPK.

In process step MP43, the call to subroutine GETAVG puts a numeric value corresponding to the motor 30 current into variable AVGPK. The call to subroutine BLINK causes the green LED to blink at a slow rate, about once per second, if current cycle is a timed cycle, and at a fast rate, about twice per second, if cycle is a calibration cycle. In decision MD16, the state of flag BEEP2 is checked. If it is reset (equal to 0), then a load is attached and the routine continues to decision MD17. If BEEP2 is set (equal to 1), no load is attached and the routine jumps to process step MP47.

In decision MD18, AVGPK (motor current) obtained in process step MP43 is compared to FAIL_LO_LIM. If AVGPK is greater than FAIL_LO_LIM, then SLOWFLAG flag is set to 1, indicating motor 30 is approaching failure (process step MP44). If AVGPK is less than FAIL_LO_LIM, then the routine jumps to decision MD19. In process step MP44, SLOWFLG is set to 1, which causes a steady, slow beep to be sent to the buzzer BZ1. In decision MD18, AVGPK (motor current) obtained in process step MP43 is compared to FAIL_UP_LIM. If it is greater than FAIL_UP_LIM, then flag FASTFLG is set to 1, indicating motor 30 is near failure (process step MP45). If AVGPK is less than FAIL_UP_LIM, then the process jumps to decision MD19.

In process step MP45, FASTFLG is set to 1, which causes a fast steady beep to be sent to buzzer BZ1 and SLOWFLG is set to 0, which stops the slow steady beep being sent to the buzzer BZ1. In decision MD19, AVGPK obtained in process step MP43 is compared to DRY_UP_LIM. If AVGPK is greater than DRY_UP_LIM, then pump 16 is sucking air, and the routine jumps to process step MP46. Otherwise, the routine proceeds to decision MD20. In decision MD20, AVGPK (motor current) obtained in process step MP43 is compared to DRY_LO_LIM. If AVGPK is less than DRY_LO_LIM, then pump 16 is sucking air, and the routine continues to process step MP46. Otherwise, the routine jumps to decision MD22. In process step MP46, RUNTIME_LIMIT is set to 0.75 multiplied by FASTTIME. The routine then continue with decision MD21. In decision MD21, RUNTIME_LIMIT is compared to MINRUNTIME. If RUNTIME_LIMIT is less than MINRUNTIME, the routine proceeds to process step MP47. If RUNTIME_LIMIT is greater than MINRUNTIME, the routine jumps to process step MP48.

In process step MP47, RUNTIME_LIMIT is set equal to MINRUNTIME. This forces the pump 16 to run for at least MINRUNTIME seconds. The routine then jumps to process step MP48. In decision MD22, motor runtime (FASTTIME) is compared to MAXRUNTIME. If runtime is greater than MAXRUNTIME, the routine jumps to process step MP47. If runtime is less than MAXRUNTIME, then the routine continues with decision MD23. In decision MD23, motor runtime (FASTTIME) is compared to RUNTIME_LIMIT. If motor runtime is greater, then the routine proceeds to process step MP48. If not, the routine loops back to process step MP43. In process step MP48, WAIT_TIME is set equal to 24. The routine then loops back to process step MP17.

In another embodiment of the present invention, the microcontroller includes several subroutines called by the main logic routine as needed. FIGS. 3.1 to 3.2 illustrate a first such subroutine, a pump controller GETAVG subroutine, along with its corresponding process steps and decisions. In general, the GETAVG subroutine reads the output of current transformer T2 after it is passed through the low-pass filter formed by R4 and C2. The negative going peaks are shunted to ground through diode D1, which protects the PB4 input of the microprocessor 12 from reverse voltages. The waveform seen by the A/D converter of the microprocessor 12 is then just the positive-going peaks of a 50/60 Hz voltage sine wave proportional to the current flowing through the primary of T2, which is the same current flowing through the attached load. Rather than capture just the peak value of the sine wave, GETAVG does a discrete mathematical integration over 4 cycles of the 50/60 Hz signal.

Figure 9:
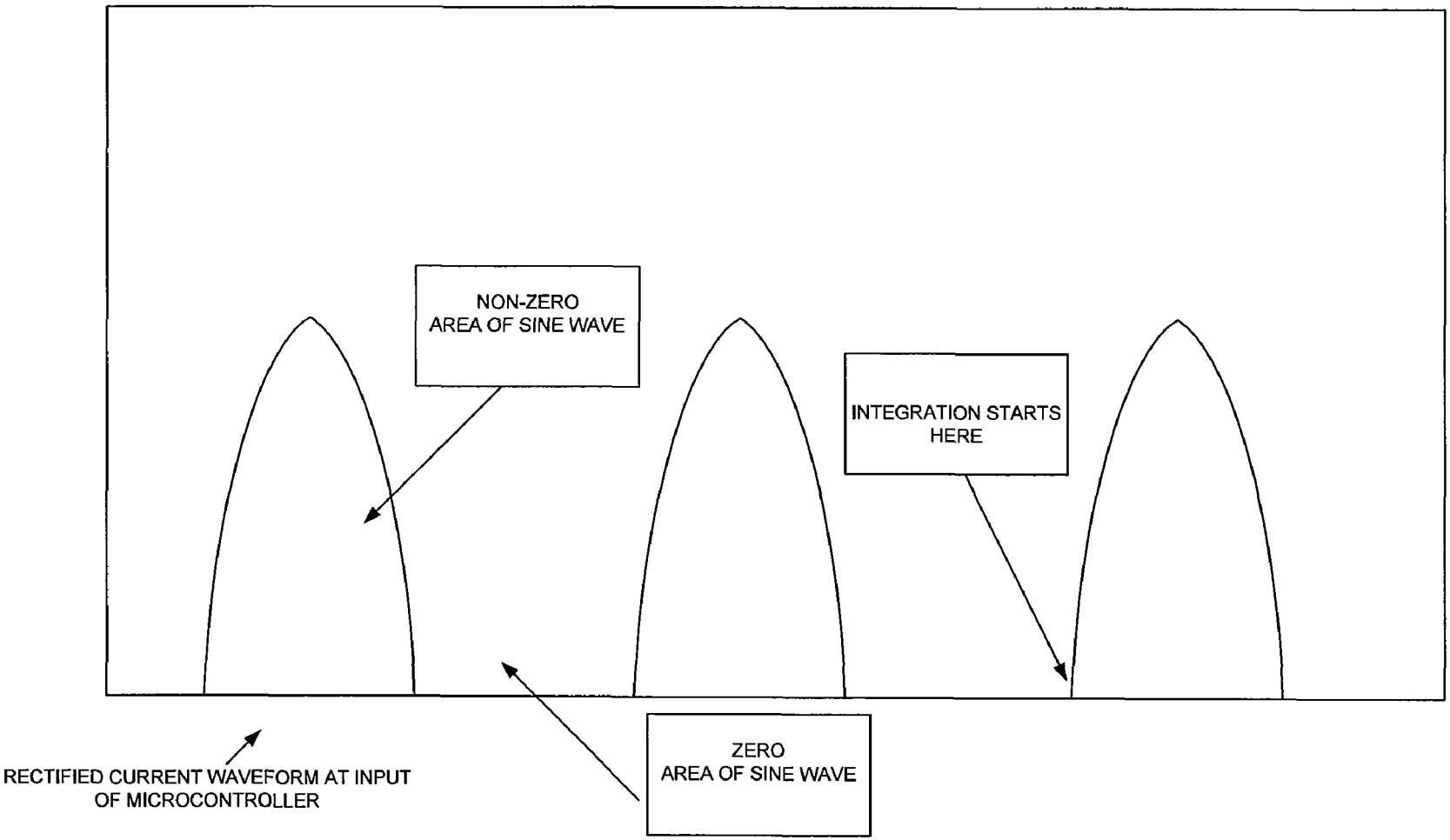
FIG. 9 is a graph showing utilization of parameters of a sine wave generated by a specific current transformer of the electronic controller device of FIG. 1 in the running of the GET AVERAGE subroutine of FIG. 3.

The following paragraphs describe in more detail the corresponding process steps and decisions of the pump controller GETAVG subroutine. The GETAVG subroutine begins by synchronizing the start of the integration with the leading edge of a half sine wave, as illustrated in FIG. 9. In process step GP1 initilization is executed. AVGPK is set equal to 0 to hold the results calculated in the GETAVG subroutine. The AC_CYCLE_CNT is set to 0. AC_CYCLE_CNT is a counter incremented once for each cycle of the 50/60 Hz sine wave. The subroutine then proceeds to process step GP2.

In process step GP2, SAMPLE_CNT is set equal to 0. SAMPLE_CNT is a counter that is incremented once each time the A/D completes a conversion. The subroutine then proceeds to process step GP3. In process step GP3, TEMP_CNT is set equal to 0. The variable TEMP_CNT is a temporary counter used to count loop iterations as required. The routine proceeds to process step GP4. In process step GP4, A/D conversion is started, putting the microprocessor 12 to sleep until conversion is completed. The results of the A/D conversion is moved into PEAK and the WD_FLG is set equal to 1, which causes a wdr instruction to be executed in the TIMER0 overflow interrupt subroutine. The SAMPLE_CNT is set equal to SAMPLE_CNT plus 1. The subroutine then proceeds to decision GD1.

In decision GD1, the value of SAMPLE_CNT is checked. If SAMPLE_CNT equals 256, then 38 ms have elapsed without finding the desired non-zero area of the 60 Hz sine wave. The process is aborted and jumps to process step GP15. If SAMPLE_CNT does not equal to 256, then the subroutine continues to decision GD2. In decision GD2, the value in PEAK is compared to 0. If PEAK is greater than 0, then the A/D is sampling somewhere in the non-zero area of the half sine wave, so the subroutine loops back to process step GP3. If PEAK is equal to 0, then the A/D is sampling somewhere in the zero voltage area of the half sine wave, so the subroutine continues with process step GP5.

In process step GP6, TEMP_CNT is set to TEMP_CNT plus 1. Variable TEMP_CNT is used to keep track of the number of times through the loop. In decision GD3, the value of TEMP_CNT is tested. If the value is less than 30, then the subroutine loops back to process step GP4. If the value is more than 30, then the subroutine continues to process step GP6. This looping ensures that a minimum of 30 consecutive samples are taken in the zero-voltage area of the 50/60 Hz sine wave before the next step in the synchronization process is permitted to proceed.

After reaching the zero voltage area of the half sine wave, the subroutine looks for the rising edge of the half sine wave. In process step GP6, the SAMPLE_CNT is set to 0. The subroutine then proceed to process step GP7. In process step GP7, TEMP_CNT is set equal to 0. The variable TEMP_CNT is a temporary counter used to count loop iterations as required. The subroutine then proceeds to process step GP8. In process step GP8, an A/D conversion is started and the microprocessor 12 is put to "sleep" until conversion is completed. The results of the A/D conversion are moved into PEAK. WD_FLG is set equal to 1, which causes a wdr instruction to be executed in the TIMER0 overflow interrupt subroutine. The SAMPLE_CNT is set to SAMPLE_CNT plus 1. The subroutine then proceeds to Decision GD4.

In decision GD4, the value of SAMPLE_CNT is checked. If SAMPLE_CNT is equal to 256, then 38 ms have elapsed without finding the desired non-zero voltage area of the 60 Hz sine wave. The process is then aborted and the subroutine jumps to process step GP15. In GD5, the value of PEAK is compared to 0. If PEAK is equal 0, then the motor 30 current is zero and the A/D is still sampling somewhere in the zero voltage area of the half sine wave, so the subroutine loops back to process step GP7. If PEAK is greater than 0, then the A/D is sampling somewhere in the non-zero voltage area of the half sine wave, so the subroutine continues with process step GP9.

Once the process has been synchronized to the leading edge of the half sine wave, the mathematical integration of the signal can proceed in process step GP9 by setting AVGPK=AVGPK plus PEAK. The subroutine then proceeds to decision GD6. In decision GD6, the value of TEMP_CNT is tested. If the value is less than 20, then the subroutine loops back to process step GP8. If the value is more than 20, then the subroutine continues to process step GP10. This looping ensure that a minimum of 20 consecutive samples are taken in the non-zero voltage area of the 50/60 Hz sine wave before the integration process can proceed to the next step.

In process step GP10, the integration process is continued by setting SAMPLE_CNT equal to 0. The subroutine then proceeds to process step GP11. In process step GP11, TEMP_CNT is set equal to 0. The variable TEMP_CNT is a temporary counter used to count loop iterations as required. The subroutine then proceeds to process step GP12. In process step GP12, an A/D conversion starts and the microprocessor 12 is put to "sleep" until conversion is completed. The results of the A/D conversion are moved into PEAK. The WD_FLG is set to 1, which causes a wdr instruction to be executed in the TIMER0 overflow interrupt subroutine. The SAMPLE_CNT is set to SAMPLE_CNT plus 1. The subroutine proceeds to decision GD7.

In decision GD7, the value of SAMPLE_CNT is checked. If SAMPLE_CNT equals 256, then 38 ms have elapsed without finding the desired zero voltage area of the 50/60 Hz sine wave. The process is aborted process and the subroutine jumps to process step GP15. In process step GP13, the integration process continues by setting AVGPK equal to AVGPK plus PEAK. In decision GD8, the value in PEAK is compared to 0. If PEAK is greater than 0, then the A/D is still sampling somewhere in the non-zero area of the half sine wave, so the subroutine continues the integration process and loops back to process step GP11. If PEAK is equal to 0, then the A/D is sampling in the zero-voltage area of the half sine wave. The subroutine then continues with decision GD9.

In decision GD9, the value of TEMP_CNT is tested. If the value is less than 10, then loop back to process step GP12. If the value is more than 10, then continue to decision GD10. This looping ensures that a minimum of 10 consecutive samples are taken in the non-zero voltage area of the 50/60 Hz sine wave before the integration process is permitted to complete. In decision GD10, the AC_CYCLE_CNT is compared to NUM_AC_CYCLES. If AC_CYCLE_CNT is less than NUM_AC_CYCLES, then the subroutine continues to process step GP14. If AC_CYCLE_CNT is equal to NUM_AC_CYCLES, then the desired number of periods of the half sine wave have been included in the AVGPK total. The subroutine jumps to process step GP16.

In process step GP14, AC_CYCLE_CNT is set to AC_CYCLE_CNT plus 1. The subroutine then loops back to process step GP2. In process step GP15, AVGPK is set equal to 0. The subroutine then continues with process step GP16. In process step GP16, flag BEEP2 is set equal to 0. The subroutine then continues with decision GD11. In decision GD11, the value of AVGPK is tested. If the value is greater than 0, then the integration process is completed successfully. The subroutine is then exited and returned to the point where it was called. If AVGPK is equal to 0, then the process was aborted before completion and the subroutine continue with process step GP17. In process step GP17, flag BEEP2 is set equal to 1, indicating that no load current was detected. The subroutine is then exited and returned to the point where it was called.

FIGS. 4.1 to 4.2 illustrate another subroutine in accordance with an embodiment of the invention. In particular, FIGS. 4.1-4.2 illustrate a pump controller TIMER0 subroutine, along with its corresponding process steps and decisions. The TIMER0 interrupt subroutine is executed whenever timer0 overflows, which is approximately 1024*256/1,600,000 seconds, or 164 ms. The following paragraphs describe in more detail the corresponding process steps and decisions of the pump controller GETAVG subroutine.

In decision TD1, the state of watch dog flag WD_FLG is checked. If it is set to 1, a wdr instruction (process step TP1) is executed. If not, then the subroutine jumps to decision TD2. In process step TP1, a wdr instruction is executed, which resets the watch dog timer back to 0. The WD_FLG flag is then cleared, and the subroutine continue with decision TD2. In decision TD1, the state of flag BEEP2 is checked. If the flag is set, then a-double beep from the buzzer BZ1 is called for and the subroutine continues with process step TP2. If the flag is not set, then the subroutine jumps to decision TD3.

In process step TP2, logic is set up to have buzzer BZ1 is set to beep a double-beep pattern that is a 1 second beep, 1 second pause, 1 second beep and 2 second pause. This pattern is repeated for as long as the flag is set. The subroutine then jumps to process step TP7. In decision TD3, the state of flag BEEP3 is checked. If the flag is set, then a triple-beep pattern from the buzzer BZ1 is called for and the subroutine continues with process step TP3. If the flag is not set, then the subroutine jumps to decision TD4. In process step TP3, buzzer BZ1 is set up to beep a triple-beep pattern that is a 1 second beep, 1 second pause, 1 second beep, 1 second pause, 1 second beep and 2 second pause. The pattern is repeated for as long as the flag is set. The subroutine then jumps to process step TP7.

In decision TD4, the state of flag BEEP4 is set. If the flag is set, then a quad-beep pattern from the buzzer BZ1 is called for and the subroutine continues with process step TP4. If the flag is not set, then the subroutine jumps to decision TD5. In process step TP4, logic is set up to have buzzer BZ1 is set to beep quad-beep pattern that is a 1 second beep, 1 second pause, 1 second beep, 1 second pause, 1 second beep, 1 second pause, 1 second beep and 2 second pause. This pattern is repeated for as long as the flag is set. The subroutine jumps to process step TP7. In decision TD5, the state of flag SLOWFLAG is set. If the flag is set to 1, then a constant slow steady beep from buzzer BZ1 is called for and the subroutine continues with process step TP5. If the flag is not set to 1, then the subroutine jumps to decision TD6.

In process step TP5, logic is set up to have buzzer BZ1 is set to beep a slow (1 second on −1 second off) pattern and continues until SLOWFLAG is reset. The subroutine then jumps to process step TP7. In decision TD6, the state of flag FASTFLAG I set. If the flag is set to 1, then a constant fast steady beep from buzzer BZ1 is called for and the subroutine continue with process step TP6. If the flag is not set, then the subroutine jumps to process step TP6. In process step TP6, logic is set up to have buzzer BZ1 beep a rapid (½ second on −½ second off) pattern and continue until FASTFLAG is reset. In process step TP7, FASTTIME is set equal to FASTTIME plus 1. In decision TD7, the value of FASTTIME is tested. If the value is equal to 256, then the subroutine proceeds to process step TP8. If the value is less than 256, then the subroutine jumps to process step TP9.

In process step TP8, FASTTIME is set equal to 255. This limits the maximum value of FASTTIME to 255. The subroutine then continue with process step TP9. In process step TP9, CLICKS is set equal to CLICKS plus 1. In decision TD8, the value of CLICK is checked. If the value is equal to 6, then 1 second has elapsed, and the subroutine continues with process step TP10. If the value is not equal to 6, then subroutine is exited. In process step TP10, CLICKS is reset to 0 to measure the next 1 second interval. Also, flag BEEP4 is set equal to 0. In decision TD9, the value number of on/off cycles over previous 60 seconds is checked. If the pump has cycled on and off fewer than 5 times, then the subroutine jumps to process step TP12. If the pump has cycled on and off for more than 5 cycles, the subroutine proceeds to process step TP11.

In process step TP11, the flag BEEP4 is set equal to 1 to indicate that pump 16 is cycling on/off too frequently (more than 5 times/minute). In process step TP12, MOTOR_OFF_

TIME is set equal to MOTOR_OFF_TIME plus 1. MOTOR_MOTOR_OFF_TIME is used to count the number of seconds between the end of one on/off cycle of the motor 30 and the start of the next on/off cycle. The value of MOTOR_OFF_TIME is checked in decision MD6 described above. In process step TP13, CLK_SECS is set to CLK_SECS plus 1. CLK_SECS is incremented once every second and is used for a number of timing purposes.

In decision TD10, the value of CLK_SECS is checked. If the value is equal to 60, then the subroutine jumps to process step TP14. If the value is not equal to 60, the subroutine is exited. In process step TP14, CLK_SECS is set to 0. In process step TP15, CLK_MINS is set equal to CLK_MINS plus 1. CLK_MINS is incremented once every minute. In decision TD11, the value of CLK_MINS is checked. If the value is equal to 60, then the subroutine continues with process step TP15. If the value is not equal to 60, then the subroutine is exited. In process step TP16, CLK_MINS is set to 0. In process step TP17, CLK_HRS is set to CLK_HRS plus 1, then the subroutine is exited. CLK_HRS is incremented once every hour.

Figure 5:
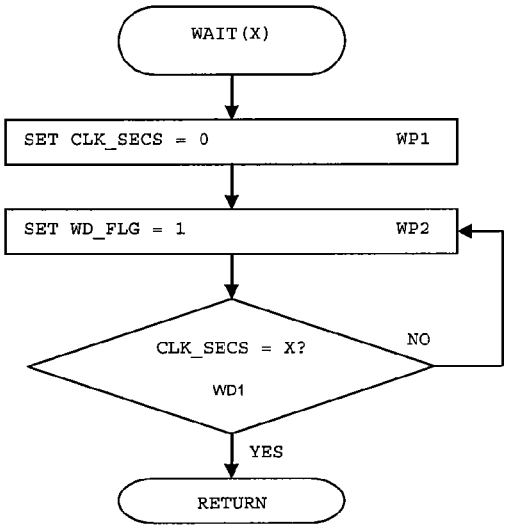
FIG. 5 is a logic flow diagram of a WAIT logic subroutine called by the main routine of FIG. 2 as needed.
Figure 6:
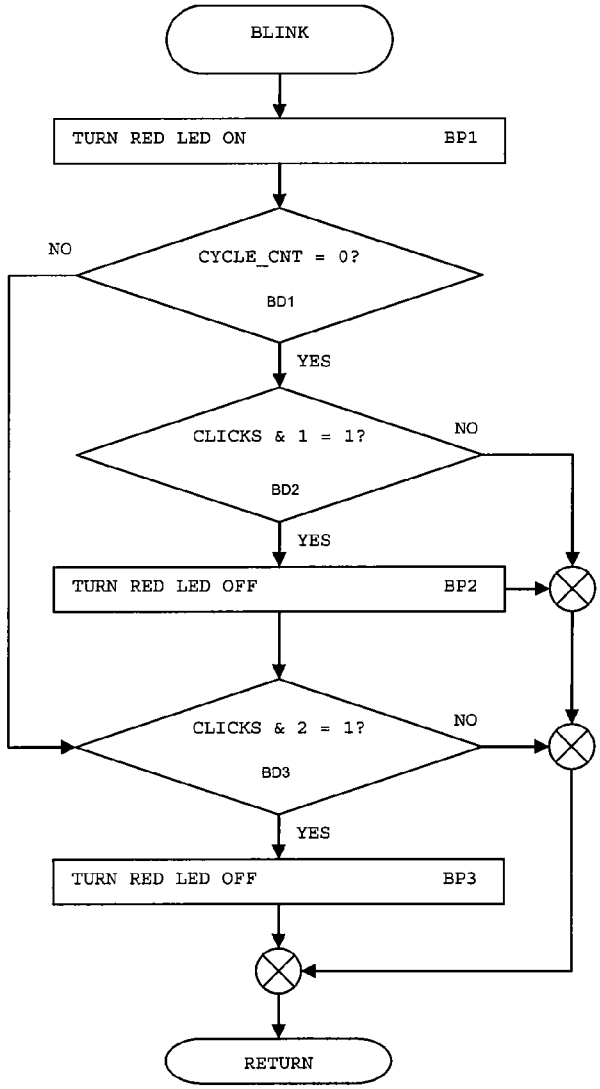
FIG. 6 is a logic flow diagram of a BLINK logic subroutine called by the main routine of FIG. 2 as needed.

FIGS. 5 and 6 illustrate two more subroutines in accordance with an embodiment of the invention. In particular, FIGS. 5 and 6 illustrate a pump controller WAIT subroutine and a pump controller BLINK subroutine respectively, along with their corresponding process steps and decisions. The WAIT subroutine uses the value passed to in the variable TEMP to insert a delay of "TEMP" seconds in the process. The BLINK subroutine is used to make the Green LED blink at a predetermined rate. The blink rate is slower for (approximately 1 second on/l second off) timed cycles, and faster (approximately .5 seconds on/0.5 seconds off) for calibration cycles. The following paragraphs describe in more detail the corresponding process steps and decisions of the pump controller WAIT subroutine.

In process step P1, CLK_SECS is set equal to 0 and then continues with process step WP2. In process step WP2, flag WD_FLG is set equal to 1, which causes a wdr instruction to be executed in TIMER0 interrupt subroutine. In decision W11, the value of CLK_SECS is compared to the value of TEMP. If CLK_SECS is less than TEMP, the subroutine loops back to process step WD2. If CLK_SECS is equal to TEMP, then the subroutine is exited.

Referring to FIG. 6, the following paragraphs describe in more detail the corresponding process steps and decisions of the pump controller BLINK subroutine. In process step BP1, PB3 is set to 1, which, when PB0 is also set to 1, prevents any current from flowing through LED1, causing both the Red and Green LED's to turn off. In decision BD1, the value in CYCLE_CNT is compared to 0. If the value is not equal to 0, the current cycle is a timed cycle and the subroutine jumps to decision BD3. If the value is equal to 0, the current cycle is a calibration cycle. And the subroutine continues with decision BD2.

In decision BD2, bit 0 of CLICKS is tested. If it is set, the subroutine continues with process step BP2. If it is not set, the subroutine is exited and returned to where it was called. Bit 0 of CLICKS changes state approximately every 500 ms. In process step BP2, PB is set to 0, turning off U1E and letting current flow through LED1. With PB0 set to 1 the Green LED will turn on. The subroutine is then exited and returns to the point where it was called. In decision BD3, bit 1 of CLICKS is tested. If it is set to 1, the subroutine continues with process step BP3. If it is not set to 1, the subroutine is exited and returns to where it was called. Bit 1 of CLICKS changes state approximately once every second. In process step BP2, PB3 is set to 0, turning off U1E and letting current flow through LED1. With PB0 set to 1 the Green LED will turn on. The subroutine is then exited and returns to the point where it was called.

Figure 7:
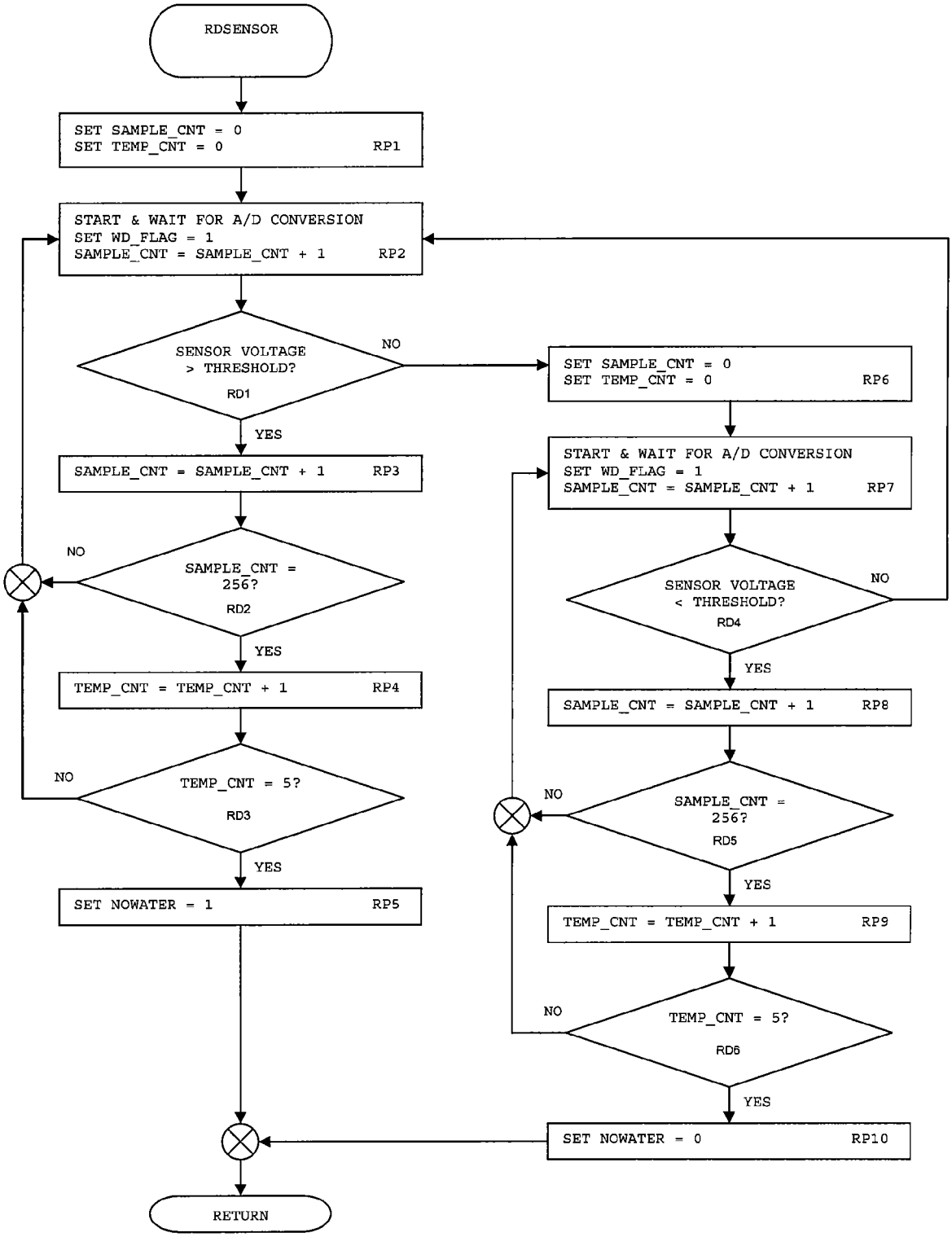
FIG. 7 is a logic flow diagram of a READ SENSOR (RD-SENSOR) subroutine called by the main routine of FIG. 2 as needed.

FIG. 7 illustrates another subroutine in accordance with an embodiment of the invention. In particular, FIG. 7 illustrates a pump controller RDSENSOR subroutine, along with its corresponding process steps and decisions. The RDSENSOR subroutine is used to read the voltage at PB2 of the microcontroller 12. If the sensor S1 is in contact with water, then current will flow from the 5 volt supply, through Resistor R1 and the water in the sump pit 14 to the grounded motor housing 18. The resultant voltage drop across R1 will pull the input to PB2 low. If the sensor S1 is not in contact with the water, no current will flow through R1 and the input to P2 will be pulled high. The following paragraphs describe in more detail the corresponding process steps and decisions of the pump controller RDSENSOR subroutine.

In process step RP1, SAMPLE_CNT is set equal to 0. TEMP_CNT is also set equal to 0. The subroutine then continues to process step RP2. In process step RP2, an A/D conversion is started and the Microprocessor 12 is put to "sleep" until conversion is completed. The results of the A/D conversion are moved into PEAK. WD_FLG is set to 1, which causes a wdr instruction to be executed in the TIMER0 overflow interrupt subroutine. SAMPLE_CNT is set to SAMPLE_CNT plus 1 and the subroutine continues to decision RD1. In decision RD1, the value of PEAK is compared with THRESHOLD. If PEAK is less than THRESHOLD, then the subroutine jumps to process step RP6. If PEAK is greater than THRESHOLD, then the subroutine continues with process step RP3.

In process step RP3, SAMPLE_CNT is set to SAMPLE_CNT plus 1. In decision RD2, the value of SAMPLE_CNT is checked. If the value is less than 256, the subroutine loops back to process step RP2. If the value is equal to 256, then the subroutine continues to process step RP4. In process step RP4, TEMP_CNT is set to TEMP_CNT+1. In decision RD3, the value of TEMP_CNT is checked. If the value is less than 5, the subroutine loops back to process step RP2. If the value is equal to 5, the subroutine continues with process step RP5. This looping action filters out noise transients on the sensor signal by requiring the signal to be above THRESHOLD for approximately 200 ms before exiting the subroutine.

In process step RP5, flag NOWATER is set to 1, indicating that water was not detected at the Sensor S1. The subroutine is then exited and returns to where it was called. In process step RP6, SAMPLE_CNT is set to 0 and TEMP_CNT is set to 0. The subroutine then continues to process step RP7. In process step RP7, an A/D conversion is started and the microprocessor 12 is put to "sleep" until conversion is completed. The results of the A/D conversion are moved into PEAK. The WD_FLG is set to 1, which causes a wdr instruction to be executed in the TIMER0 overflow interrupt subroutine. SAMPLE_CNT is set to SAMPLE_CNT plus 1. The subroutine then proceeds to decision RD4.

In decision RD4, the value of PEAK is compared with THRESHOLD. If PEAK is greater than THRESHOLD, then the subroutine jumps to process step RP2. If PEAK is less than THRESHOLD, then continue with process step RP8. In process step RP8, SAMPLE_CNT is set to SAMPLE_CNT plus 1. In decision RD5, the value of SAMPLE_CNT is checked. If the value less than 256, the subroutine loops back to process step RP7. If the value is equal to 256, then the subroutine continues to process step RP9.

In process step RP9, TEMP_CNT is set to TEMP_CNT plus 1. In decision RD6, the value of TEMP_CNT is checked.

If the value is less than 5, the subroutine loops back to process step RP7. If the value is equal to 5, then the subroutine continues with process step RP10. This looping action filters out noise transients on the Sensor signal by requiring the signal to be above THRESHOLD for approximately 200 ms before exiting the subroutine. In process step RP10, NOWATER flag is set to 0, indicating that water was detected at the Sensor S1. The subroutine is then exited and returned to where it was called.

FIG. 8 is a representative computer system for assisting in the implementation of the main and subroutines for the monitoring and control of a pump in accordance with an embodiment of the invention. In FIG. 8, the computer system 800 includes a memory 801, application program 803, central processor 805, central bus 807, and user interface 809. The memory 801 can be computer-readable media used to store executable instructions or code thereon. The term "computer program product" as used herein is intended to encompass a computer program that exists permanently or temporarily on any computer-readable medium. The memory 801 can be ROM, RAM, PROM, EPROM, smart card, SIMs, WIMs or any other medium from which a computing device can read executable instructions or code.

The executable instructions stored in the memory 801 are executable by one or more processors 805, which are facilitated by the application program 803. The application program 803 can be an operating system or any special computer program that manages the relationship between application software and any suitable variety of hardware known in the art that helps to make-up a computer system or computing environment. The executable instructions in the memory 801 include instructions for performing steps of the main routine and subroutines of the present invention.

The computer system 800 and the pump controller 10 may also include a communication interface (not shown). The communication interface provides for two-way data communications via the communications link 813. For example, the communication interface can be a local area network (LAN) card (e.g., for Ethernet™ or an Asynchronous Transfer Model (ATM) network) provide a data communication connection to a compatible LAN. Further, the communication interface can also include peripheral interface devices, such as a Universal Serial Bus (USB) interface, a PCMCIA (Personal Computer Memory Card International Association) interface, and the like. The computer system 800 can send and receive data through the network link 813, and communication interface. The network link can be any standard network connection for establishing data communication between network device, such as a USB connection or the like.

Finally, the user interface 809 can include any means by which a user can interact with the computer system 800. It should be understood by one or ordinary skill in the art that the user interface can include any suitable means known in the art for input by (i.e., allowing the users to input data and control the computer system 800) and output to (i.e., allowing the user to receive data and other information from the computer system 800) a user.

The computer system 800 can be implemented for carrying out the features of the apparatus, system and method of the invention as disclosed. In the alternative, the computer system 800 can be implemented in any suitable computing device known in the art for carrying out the features of the apparatus system and method of the invention as disclosed. From the description of the computer system 800, those skilled in the art should be readily able to combine software created as described with appropriate general purpose or special purpose computing hardware for carrying out the features of the invention.

It should also be understood that various changes and modifications to the presently preferred embodiments described herein will be apparent to those skilled in the art. Such changes and modifications can be made without departing from the spirit and scope of the present subject matter and without diminishing its intended advantages.

For example, it should be understood by one of ordinary skill in the art that the sump pump system noted above is meant to be exemplary, and the other system are contemplated. For example, the pump control apparatus, system, method and computer program product of the present invention can also be implemented for ejector pits/systems, water collection wells, process water holding tanks, waste storage tanks, or in other similar commercial and industrial pumping operations. It is therefore intended that such changes and modifications be covered by the appended claims.

The invention is claimed as follows:

1. A pump control apparatus, comprising:

a power circuit connectable to and controlling power to a pump;

a current sensing circuit for monitoring current flowing at the pump;

a controller connectable to and receiving at least one input from the current sensing circuit wherein the at least one input includes a rectified current waveform and is derived from sensed current data and does not depend on voltage data, and determining from the at least one input a baseline operating current and a plurality of operating conditions affecting an operation of the pump, wherein the baseline operating current is calculated from an area under the rectified current waveform; and an alarm circuit connectable to and receiving at least one output from the controller, the alarm circuit providing a plurality of alarm indications corresponding to the plurality of operating conditions determined by the controller.

2. The apparatus according to claim 1, further comprising a level sensing circuit for sensing a liquid level and providing a further input to the controller.

3. The apparatus according to claim 1, wherein the current sensing circuit further comprises a current transformer being arranged so that current flowing through the current transformer is proportional to the current flowing at the pump.

4. The apparatus according to claim 3, wherein the current sensing circuit further comprises a rectifier circuit connectable to the current transformer and the controller for providing the rectified current waveform to the controller.

5. The apparatus according to claim 4, wherein the controller calculates the baseline current from the area under the rectified current waveform over four complete 50/60 Hertz cycles.

6. The apparatus according to claim 1, the alarm circuit includes at least one of visual and audible alarm indications.

7. The apparatus according to claim 1, wherein the power circuit further comprises an electrical switch connectable to the controller, wherein the switch is regulated by the controller for controlling the power to the pump.

8. A pump control system, comprising:

a power supply connectable to and providing primary power to a pump; and a pump controller, the controller comprising:

a power circuit for regulating a connection between the power supply and the pump;

a current sensing circuit for monitoring current flowing to the pump;

a central controller connectable to and receiving an input from the current sensing circuit wherein the input includes a rectified current waveform and is derived from sensed current data and does not depend on voltage data, and determining from the input a baseline operating current and a plurality of operating conditions affecting an operation of the pump, wherein the baseline operating current is calculated from an area under the rectified current waveform; and an alarm circuit connectable to and receiving at least one output from the central controller and providing a plurality of alarm indications corresponding to the plurality of operating conditions determined by the central controller.

9. The system according to claim 8, further comprising a level sensing circuit for sensing a liquid level and providing a further input to the central controller.

10. The system according to claim 9, wherein the level sensing circuit includes an electrical sensor located at a predetermined level in a liquid collection area that establishes a complete electrical path in the level sensing circuit when the liquid level contacts the sensor.

11. The system according to claim 10, wherein the pump is located outside the liquid collection area.

12. The system according to claim 11, wherein the liquid collection area is a sump pit.

13. The system according to claim 8, further comprising a general computer system connectable to the pump controller.

* * * * *